US007572969B2

(12) United States Patent
Koseki et al.

(10) Patent No.: US 7,572,969 B2
(45) Date of Patent: Aug. 11, 2009

(54) METHOD FOR MAKING ELECTRONIC TONES CLOSE TO ACOUSTIC TONES, RECORDING SYSTEM FOR THE ACOUSTIC TONES, TONE GENERATING SYSTEM FOR THE ELECTRONIC TONES

(75) Inventors: Shinya Koseki, Hamamatsu (JP); Rokurota Mantani, Hamamatsu (JP); Takashi Tamaki, Hamamatsu (JP); Nobuo Sugiyama, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 654 days.

(21) Appl. No.: 11/220,992

(22) Filed: Sep. 6, 2005

(65) Prior Publication Data

US 2006/0005691 A1 Jan. 12, 2006

Related U.S. Application Data

(62) Division of application No. 10/417,982, filed on Apr. 17, 2003, now Pat. No. 7,002,068.

(30) Foreign Application Priority Data

Apr. 22, 2002 (JP) ..... 2002-119833

(51) Int. Cl.
*G10H 1/00* (2006.01)
*G10H 1/18* (2006.01)

(52) U.S. Cl. ..... 84/615; 84/604; 84/609; 84/616; 84/622

(58) Field of Classification Search ..... None
See application file for complete search history.

(56) References Cited

U.S. PATENT DOCUMENTS 5,192,824 A 3/1993 Shibukawa
5,247,129 A 9/1993 Nozaki et al.
5,652,403 A 7/1997 Sugiyama et al.
5,739,450 A 4/1998 Fujiwara et al.
5,753,842 A 5/1998 Kitamura (Continued)

FOREIGN PATENT DOCUMENTS

JP 05-62749 9/1993

(Continued)

OTHER PUBLICATIONS

Notice of allowance for U.S. Appl. No. 11/221,244 filed Sep. 6, 2005, Inventor: Shinya Koseki et al., Notice of Allowance mailed Feb. 24, 2009.

*Primary Examiner*—Marlon T Fletcher
(74) *Attorney, Agent, or Firm*—Morrison & Foerster LLP

(57) ABSTRACT

A grand piano generates acoustic tones through vibrations of strings and sound board so that the acoustic tones are converted to analog audio signals at recording points over the sound board, and a group of waveform data sets are produced from the analog audio signal through sampling and analog-to-digital conversion; when electronic tones are generated, delay parameters and volume parameters are determined on the basis of differences between the recording points and tone radiating points occupied by loud speakers, the sets of waveform data series are sequentially read out from the group of waveform data sets and are modified with the delay parameters and volume parameters so that the electronic tones become close to the acoustic tones.

18 Claims, 11 Drawing Sheets

U.S. PATENT DOCUMENTS

| | | | | |
|---|---|---|---|---|
| 5,822,438 | A | 10/1998 | Sekine | |
| 6,362,405 | B2 | 3/2002 | Koseki et al. | |
| 6,867,359 | B2 | 3/2005 | Koseki et al. | |
| 7,002,068 | B2 * | 2/2006 | Koseki et al. | 84/604 |
| 2001/0007219 | A1 | 7/2001 | Uehara et al. | |
| 2003/0121403 | A1 | 7/2003 | Miyagishima et al. | |
| 2003/0131717 | A1 | 7/2003 | Shiiya | |
| 2003/0172798 | A1 | 9/2003 | Fujiwara et al. | |
| 2003/0177886 | A1 | 9/2003 | Koseki | |
| 2003/0177890 | A1 | 9/2003 | Furukawa | |
| 2003/0196539 | A1 * | 10/2003 | Koseki et al. | 84/604 |
| 2006/0000343 | A1 * | 1/2006 | Koseki et al. | 84/604 |

FOREIGN PATENT DOCUMENTS

| | | |
|---|---|---|
| JP | 07-234666 | 9/1995 |
| JP | 8-50479 | 2/1996 |
| JP | 8-190375 | 7/1996 |

* cited by examiner

| k(0) | n(0) | n(1) | n(2) | n(3) | n(4) | n(5) | n(6) | v(0) | v(1) | v(2) | v(3) | v(4) | v(5) | v(6) |
|---|---|---|---|---|---|---|---|---|---|---|---|---|---|---|
| 1 | 0 | 1 | 1 | 1 | 1 | 0 | 0 | 1 | 1 | 0 | 0 | 1 | 0 | 0 |

n-bits ⟷ v-bits

| | a(0) | a(1) | a(2) | a(3) | a(4) | b(0) | c(0) | c(1) | c(2) | c(3) | c(4) | c(5) | c(6) |
|---|---|---|---|---|---|---|---|---|---|---|---|---|---|
| 0 | 0 | 0 | 0 | 1 | 1 | 1 | 0 | 1 | 0 | 1 | 1 | 1 | 0 |
| 1 | 0 | 0 | 1 | 1 | 0 | 1 | 1 | 0 | 1 | 0 | 1 | 1 | 1 |
| 2 | 0 | 1 | 1 | 1 | 1 | 1 | 1 | 0 | 0 | 0 | 1 | 0 | 1 |
| 3 | 1 | 0 | 0 | 1 | 0 | 1 | 1 | 1 | 0 | 0 | 1 | 0 | 0 |
| ⋮ | ⋮ | ⋮ | ⋮ | ⋮ | ⋮ | ⋮ | ⋮ | ⋮ | ⋮ | ⋮ | ⋮ | ⋮ | ⋮ |
| 29 | 1 | 0 | 0 | 0 | 1 | 1 | 0 | 1 | 0 | 0 | 0 | 0 | 1 |
| 30 | 1 | 1 | 1 | 0 | 0 | 0 | 0 | 0 | 0 | 0 | 0 | 0 | 0 |
| 31 | 0 | 0 | 1 | 1 | 1 | 0 | 0 | 0 | 0 | 0 | 0 | 0 | 0 |

a-bits ⟷ c-bits

| QUEUES | VOLUME PARAMETERS | DELAY PARAMETERS (ms) |
|---|---|---|
| AA | 0.0546 | 7794 |
| AB | 0.0360 | 7326 |
| AC | 0.0322 | 7840 |
| AD | 0.0440 | 8956 |
| BA | 0.0514 | 8100 |
| BB | 0.0365 | 7260 |
| BC | 0.0365 | 7260 |
| BD | 0.0514 | 8100 |
| CA | 0.0440 | 8956 |
| CB | 0.0322 | 7840 |
| CC | 0.0360 | 7326 |
| CD | 0.0546 | 7794 |
| DA | 0.1401 | 3971 |
| DB | 0.1029 | 3632 |
| DC | 0.0742 | 4580 |
| DD | 0.0817 | 5935 |
| EA | 0.1179 | 4542 |
| EB | 0.1083 | 3496 |
| EC | 0.1083 | 3496 |
| ED | 0.1179 | 4542 |
| FA | 0.0817 | 5935 |
| FB | 0.0742 | 4580 |
| FC | 0.1029 | 3632 |
| FD | 0.1401 | 3971 |
| GA | 1.0000 | 0 |
| GB | 0.2939 | 1448 |
| GC | 0.1246 | 3144 |
| GD | 0.1225 | 4412 |
| HA | 0.1225 | 4412 |
| HB | 0.1246 | 3144 |
| HC | 0.2939 | 1448 |
| HD | 1.0000 | 0 |

Fig. 13

METHOD FOR MAKING ELECTRONIC TONES CLOSE TO ACOUSTIC TONES, RECORDING SYSTEM FOR THE ACOUSTIC TONES, TONE GENERATING SYSTEM FOR THE ELECTRONIC TONES

CROSS REFERENCE TO RELATED APPLICATION

This application is a division of application Ser. No. 10/417,982 filed on Apr. 17, 2003, the entire contents of which are incorporated herein by reference.

FIELD OF THE INVENTION

This invention relates to recording and electronic tone generating technologies and, more particularly, to a method for making electronic tones close in impression to acoustic tones, a recording system for producing pieces of waveform data from the acoustic tones and a tone generating system for reproducing the electronic tones from the pieces of waveform data.

DESCRIPTION OF THE RELATED ART

Musical instruments are broken down into two categories, i.e., acoustic musical instruments and electronic musical instruments. These two sorts of musical instruments have their merits and demerits. The acoustic musical instruments are popular to both old and young. The acoustic tones are familiar to most music lovers, and are rich. However, several acoustic musical instruments are bulky, and the players feel it difficult to produce faint tones throughout a piece of music. When a city dweller plays a piece of music on an acoustic musical instrument, he or she is careful of the tones, because the neighborhood sometimes makes a complaint against him or her.

On the other hand, the electronic musical instruments are usually less bulky rather than corresponding acoustic musical instruments. Players easily play pieces of music at extremely small loudness, because the players can control the amplifiers between a large gain to a small gain. If the players hear their performance through headphones, they do not need to be afraid for the neighborhood. However, the electronic tones are not so rich as the acoustic tones.

The electronic musical instruments can generate the electronic tones close in impression to the acoustic tones. While a player is performing a piece of music on the electronic musical instrument, the player specifies the pitch of tones to be generated with the keys, and pieces of waveform data are read out from the addresses corresponding to the manipulated keys, and produces an audio signal from the pieces of waveform data read out from the addresses of a waveform memory. The audio signal is supplied to a sound system, and is converted to electronic tones. The pieces of waveform data were obtained through a sampling on an analog audio signal representative of the acoustic tones produced through the corresponding acoustic musical instrument.

The pieces of waveform data are produced as follows. First, an acoustic tone is generated from the acoustic musical instrument, and is converted to the analog audio signal. The analog audio signal is sampled at a certain frequency so that a series of discrete values of magnitude is obtained. The series of discrete values is representative of the waveform of the tone. The discrete values are converted to digital codes, and the digital codes form the pieces of waveform data. The sampling and data conversion are repeated for other tones, and the pieces of waveform data are stored in the waveform memory at different addresses.

The pulse width modulation technology may be used in the data conversion. Another modulation technology is available for the pieces of waveform data, and an electronic musical instrument may have a waveform memory for storing the pieces of waveform data produced through the other modulation technology. In the following description, the electronic musical instruments, which produce the audio signals from the pieces of waveform data, are referred to as "sampled data storage type electronic musical instrument".

One of the attractive points of the sampled data storage type electronic musical instrument is to be capable of producing the electronic tones close in impression to the acoustic tones. However, the sampling points are influential in the analogy to the acoustic tones. In detail, a sampler is assumed to generate an acoustic tone through the corresponding acoustic musical instrument. The timbre of the acoustic tone is delicately different from one another in the sampling space around the acoustic musical instrument. For example, a listener feels the acoustic tones delicately different in timbre between a position in front of the acoustic musical instrument and another position at the back of the acoustic musical instrument. Nevertheless, the acoustic tones are usually converted to the analog audio signal at one sampling point around the acoustic musical instrument or at two sampling points on the right and left sides of the acoustic musical instrument. The electronic tone is reproduced from the pieces of waveform data sampled at the single or two sampling points. This is the reason why the listener feels the electronic tones flat.

Another factor influential in the analogy is the individuality of the acoustic musical instruments. The listener feels the acoustic tones generated through a concert grand piano different from the acoustic tones generated through a standard grand piano. The acoustic tones of the concert grand piano are richer than the acoustic tones of the standard grand piano. However, it is difficult to impart the delicate nuances of the acoustic tones produced through the concert grand piano to the electronic tones produced on the basis of the pieces of waveform data sampled from the acoustic tones generated through the standard grand piano.

In order to make the electronic tones closer in impression to the acoustic tones, a sampled data storage type electronic musical instrument is disclosed in Japan Patent Publication of Examined Application No. hei 5-62749. Japan Patent Publication of Examined Application No. hei 5-62749 is based on Japan Patent Application No. sho 59-217419 filed on Oct. 18, 1984. The prior art sampled data storage type electronic musical instrument is equipped with loud speakers disposed at sampling points. The pieces of waveform data were sampled at the sampling points, and were stored in the waveform memory. When a player depresses a key assigned a pitch name, the pieces of waveform data are sequentially read out from the address through different channels, and produce the audio signals from the pieces of waveform data supplied through the different channels. The audio signals are respectively supplied to the loud speakers, and are converted to the electronic tone through the loud speakers. The audio signals are produced from the pieces of waveform data sampled at the different sampling points, and are supplied to the loud speakers disposed at the respective sampling points. This results in that the electronic tone much closer in impression to the corresponding acoustic tone than the prior art standard sampled data storage type electronic musical instrument. The sampled data storage type electronic musical instrument of the type producing the audio signals through the different channels is hereinbelow referred to as "multi-channel sampled data storage type electronic musical instrument".

Although the prior art multi-channel sampled data storage type electronic musical instrument produces the electronic tones improved in acoustic radiation characteristics, a problem is encountered in the prior art multi-channel sampled data storage type electronic musical instrument in that it occupies the space as wide as the space occupied by a corresponding acoustic musical instrument. If the pieces of waveform data are sampled at points on both sides of a sound board of a grand piano, the loud speakers are to be spaced by the distance equal to the distance between the sampling points, and the multi-channel sampled data storage type electronic musical instrument occupies at least as wide as the sound board. Thus, the prior art multi-channel sampled data storage type electronic musical instrument is too bulky to use in an apartment in a downtown area.

SUMMARY OF THE INVENTION

It is therefore an important object of the present invention to provide a method, through which electronic tones are made close in impression to acoustic tones without any bulky facility.

It is also an important object of the present invention to provide a recording system, which prepares a group of music data and positional data required for pieces of control data used in generation of the electronic tones close in impression to the acoustic tones without any bulky tone generating system.

It is also an important object of the present invention to provide the tone generating system, which generates the electronic tones close in impression to the acoustic tones without a wide occupation space.

In accordance with one aspect of the present invention, there is provided a method for making electronic tones close to acoustic tones comprising the steps of a) preparing a group of waveform data sets representative of the acoustic tones at least one recording point, b) determining pieces of control data representative of influences on the electronic tones due to a difference between the aforesaid at least one recording point and at least one tone radiating point where the electronic tones are to be radiated, c) designating electronic tones to be generated, d) selecting sets of waveform data series representative of the electronic tones to be generated from the group of waveform data sets, e) modifying the sets of waveform data series with the pieces of control data for producing sets of modified waveform data series, and f) converting the sets of modified waveform data series to the electronic tones at the aforesaid at least one tone radiating point.

In accordance with another aspect of the present invention, there is provided a recording system for preparing data used for generating electronic tones comprising an acoustic musical instrument selectively generating acoustic tones, a sound-to-electric signal converter for converting the acoustic tones to pieces of at least one analog audio signal at least one recording point, and a recorder connected to the sound-to-electric signal converter and producing a group of waveform data sets representative of the acoustic tones from the pieces of at least one analog audio signal and at least one piece of positional data representative of the aforesaid at least one recording point so that the group of waveform data sets and the aforesaid at least one piece of positional data are stored in a data storage forming a part thereof.

In accordance with yet another aspect of the present invention, there is provided a sound generating system for generating electronic tones close to acoustic tones comprising a data processing system including a data storage so as to store a group of waveform data sets representative of the acoustic tones and pieces of control data representative of influences on the electronic tones due to a difference between at least one recording point where the acoustic tones are recorded and at least one tone radiating point where the electronic tones are to be radiated, selecting sets of waveform data series representative of electronic tones to be generated from the group of waveform data sets and modifying the sets of waveform data series with the pieces of control data for producing sets of modified waveform data series, and a sound system connected to the data processing system, and converting the sets of modified waveform data series to the electronic tones at the aforesaid at least one tone radiating point.

BRIEF DESCRIPTION OF THE DRAWINGS

The features and advantages of the method, recording system and tone generating system will be more clearly understood from the following description taken in conjunction with the accompanying drawings, in which FIG. 13 is a view showing a list of delay parameters and volume parameters.

DESCRIPTION OF THE PREFERRED EMBODIMENTS

In the following description, term "front" is indicative of a position closer to a player than a position modified with "rear", and a direction passing through a front position and the corresponding rear position is referred to as "longitudinal direction". Term "lateral direction" is indicative of the direction crossing the lateral direction at right angle.

A series of pieces of waveform data is representative of a tone. When a tone is recorded at plural recording points, plural series of pieces of waveform data are representative of the tone, and form in combination a set of waveform data series. Tones sequentially produced along a scale are represented by plural sets of waveform data series, and the plural sets of waveform data series form a group of waveform data sets.

First Embodiment

System Configuration

Figure 1A:
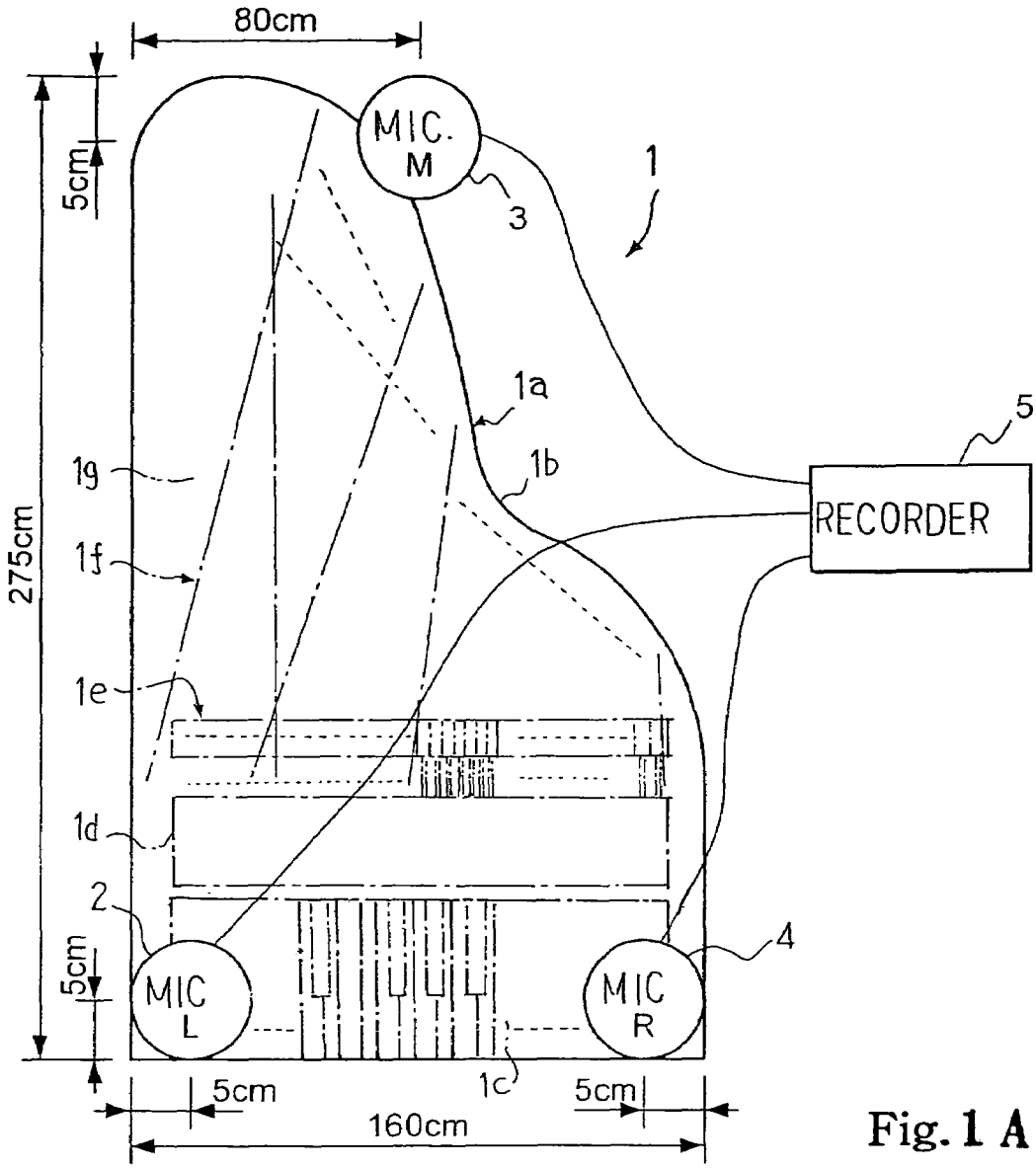
FIG. 1A is a schematic plane view showing a recording system according to the present invention.
Figure 1B:
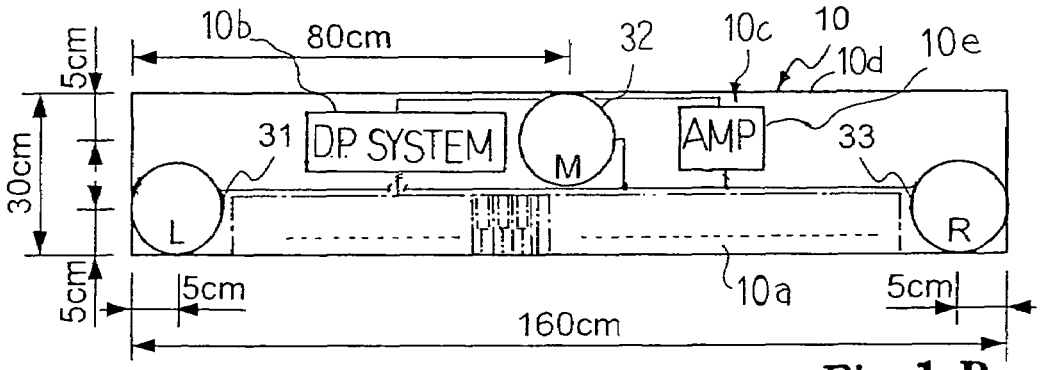
FIG. 1B is a schematic plane view showing an electronic musical instrument according to the present invention.

Referring to FIGS. 1A and 1B, reference numerals 1 and 10 respectively designate a recording system 1 and a multi-channel sampled data storage type electronic musical instrument 10. In this instance, the multi-channel sampled data storage type electronic musical instrument 10 is categorized in the keyboard instrument, and the multi-channel sampled data storage type electronic keyboard musical instrument 10 serves as a tone generating system.

The recording system 1 generates acoustic tones, and converts the acoustic tones to an analog audio signal at plural recording points. The recording system 1 samples discrete values of the magnitude from the analog audio signal, and converts the plural series of discrete values to a set of waveform data series for each acoustic tone. Thus, the recording system 1 obtains plural sets of waveform data series, and stores at least one group of waveform data sets for plural acoustic tones in a data holder. The recording system 1 further obtains pieces of positional data representative of the recording points. It is preferable to further obtain a piece of tone color data representative of the timbre of the tones. A tone color code is representative of the piece of tone color data, and is indicative of a holder address. Thus, the pieces of positional data and piece of tone color data are stored in the data holder.

The multi-channel sampled data storage type electronic keyboard 10 generates each electronic tone at plural tone radiating points. In this instance, the plural tone radiating points are different from the plural recording points. The plural tone radiating points are represented by pieces of positional data. The multi-channel sampled data storage type electronic keyboard 10 compares the pieces of positional data representative of the recording points with the pieces of positional data representative of the tone radiating points, and determines pieces of control data in such a manner that the pieces of control data make the electronic tones equivalent to the acoustic tones. The multichannel sampled data storage type electronic keyboard 10 internally stores the pieces of control data, and waits for keying-in.

While a player is sequentially depressing keys, the multi-channel sampled data storage type electronic keyboard 10 selectively accesses the data holder, and reads out the sets of waveform data series from the data holder for producing plural audio signals from the sets of waveform data series. The multi-channel sampled data storage type electronic keyboard 10 modifies the audio signals on the basis of the pieces of control data, and converts the modified audio signals to the electronic tones. The pieces of control data make the modified audio signals different from signal characteristics from the audio signals, and the differences in signal characteristics are influential in generating the acoustic tones. The electronic tones produced from the modified audio signals are closer to the original acoustic tone than electronic tones produced from the non-modified audio signals. Thus, the multi-channel sampled data storage type electronic keyboard 10 modifies the audio signals with the pieces of control data so that the electronic tones are as close in impression as the electronic tones reproduced through the prior art multi-channel sampled data storage type electronic musical instrument. Moreover, the multi-channel sampled data storage type electronic keyboard 10 does not occupy the space to be required for the recording system 1. This is because of the fact that the tone radiating points does not need to be consistent with the recording points. Even though the tone generating points are located in an area narrower than the area required for the recording points, the multi-channel sampled data storage type electronic keyboard 10 makes the electronic tones equivalent to the corresponding acoustic tones through the data processing for modifying the audio signals.

In detail, the recording system 1 comprises an acoustic musical instrument 1*a*, three microphones 2, 3 and 4 and a recorder 5. In this instance, the acoustic musical instrument 1*a* is a concert grand piano. The concert grand piano 1*a* includes a huge piano case 1*b*, a keyboard 1*c*, action units 1*d*, hammers 1*e*, strings 1*f* and a sound board 1*g*. The huge piano case 1*b* has an external appearance like a wing, and defines an internal space. The sound board Ig defines a part of the bottom of the inner space. The action units 1*d*, hammers 1*e* and strings 1*f* are arranged in the inner space, and the keyboard 1*c* is mounted on a front portion of the piano case 1*a* in such a manner that a pianist, who sits on a stool, is capable of fingering thereon. The position at which the stool occupies is the origin of coordinate system.

The concert grand piano 1*a* occupies most of the space to be required for the recording system 1, and measures 160 centimeters in width and 276 centimeters in length. The keyboard 1*c* has eighty-eight keys, and a pianist specifies the pitch of the acoustic tones to be produced by depressing the eighty-eight keys. Note numbers are respectively assigned to the acoustic tones, and are "21" to "108" as defined in the MIDI (Musical Instrument Digital Interface) standards. Accordingly, the eighty-eight keys are hereinafter numbered from "21" to "108". The note number "21" is assigned to the leftmost key, and the note number is increased toward the rightmost key.

The eighty-eight keys are respectively linked with the action units 1*d* so that the action units 1*d* are selectively actuated with the depressed keys. The action units 1*d* are respectively associated with the hammers 1*e*, which in turn are respectively associated with the strings 1*f*. The strings 1*f* are stretched over the sound board 1*g*. The hammers 1*e* are driven for rotation by the actuated action units 1*d*, and strike the associated strings 1*f* at the end of the rotation.

When the strings 1*f* are struck with the hammers 1*e*, the strings 1*f* vibrate, and the vibrating strings 1*f* give rise to vibrations of the sound board 1*g*. Thus, the large acoustic tones are generated through the convert grand piano 1*a*.

The microphones 2, 3 and 4 are disposed around the periphery of the sound board 1*g*. In this instance, the microphones 2, 3 and 4 are of the type having a voice coil and a diaphragm. The microphone 2 is disposed at the left side in the front portion of the piano case 1*b*, and has the center spaced from the front end line by 5 centimeters and from the left sideline by 5 centimeters.

The microphone 4 is disposed at the right side in the front portion of the piano case 1*b*, and the microphone 4 has the center spaced from the front end line by 5 centimeters and from the right sideline by 5 centimeters. The microphone 3 is disposed at the rear portion of the piano case 1*b*, and has the center spaced from the front end line by 270 centimeters and from the left sideline by 80 centimeters. Coordinates are to be given to the recording pints L, M and R in the coordinate system.

The microphones 2, 3 and 4 convert the acoustic tones to the analog audio signals representative of the waveform of each acoustic tone at the recording points. The microphones 2, 3 and 4 are connected in parallel to the recorder 5, and the recorder 5 creates the data holder for at least one group of waveform data sets. In detail, the recorder 5 samples the analog audio signals at a predetermined frequency, and converts the discrete values of the magnitude on the analog audio signals. The discrete values supplied from each microphone 2/3/4 are coded into a series of pieces of waveform data representative of each acoustic tone, and the plural series of pieces of waveform data form a set of waveform data series for each acoustic tone. While the eighty-eight keys are sequentially depressed for generating the acoustic piano tones, the recorder 5 repeats the sampling, encoding and memorization of plural sets of waveform data series so that a group of waveform data sets are stored in the data holder. The recorder adds the pieces of positional data representative of the recording points to the group of waveform data sets. In this instance, the piece of tone color data representative of the timbre of piano tones is further stored in the data holder.

The multi-channel sampled data storage type electronic keyboard musical instrument 10 includes a keyboard 10*a*, a data processing system 10*b*, a sound system 10*c* and a cabinet 10*d*. The cabinet 10*d* measures 160 centimeters in width and 30 centimeters in length. Although the width is equal to the width of the concert grand piano 1*a*, the length is much less than the length of the concert grand piano 1*a*. Thus, the multi-channel sampled data storage type electronic keyboard musical instrument 10 occupies the space much narrower than the space required for the concert grand piano 1*a*.

The keyboard 10*a* is mounted on the cabinet 10*d*, and is exposed to a player. The player sits on a stool at the back of the keyboard 10*a*, and the stool is disposed at a certain position equivalent to the origin of the coordinate system. For this reason, the tone generating points L, M and R are plotted in a coordinate system same as the coordinate system for the recording points L, M and R.

The data processing system 10*b* and sound system are housed in the cabinet 10*d*, and generates the electronic tones in response to the keying-in. In this instance, the left loud speaker 31 is disposed at the left tone generating point L, which is spaced from the left sideline by 5 centimeters and from the front end line by 5 centimeters, and the right loud speaker 33 is disposed at the right tone generating point R, which is spaced from the right sideline by 5 centimeters and from the front end line by 5 centimeters. The center loud speaker 32 is disposed at the middle tone generating point M, which is spaced from the rear end line by 5 centimeters and from the left sideline by 80 centimeters.

Comparing the measurements inserted in FIG. 1A with the measurements inserted in FIG. 1B, the left loud speaker 31 and right loud speaker 33 are plotted at the coordinates equivalent to the coordinates given to the left recording point L and the coordinates given to the right recording point R, respectively. However, the middle tone generating point M is plotted in the coordinate system differently from the middle recording point M. The pieces of positional data representative of the tone radiating points L, M and R were given to the data processing system 10*b*, and the data processing system 10*b* have already determined the pieces of control data are determined.

An amplifier 10*e* and loud speakers 31/32/33 form parts of the sound system 10*c*. Eighty-eight keys form in combination the keyboard 10*a*, and are selectively depressed by a player. The data processing system 10*b* periodically checks the keyboard 10*a* to see whether or not any one of the eighty-eight keys is depressed for generating the electronic tone. The data holder has been already transferred to the data processing system 1*b*, and the sets of waveform data series are selectively read out from the holder for generating the audio signals through plural channels. The data processing system 10*b* modifies the audio signals with the pieces of control data, and, thereafter, supplies them to the sound system 10*c*. The audio signals are equalized and amplified through the amplifier 10*e*, and are, thereafter, supplied to the loud speakers 31, 32 and 33, respectively. The audio signals are converted to the electronic tones through the loud speakers 31, 32 and 33.

Assuming now that a user wishes to create the data holder for a group of waveform data sets actually produced through the concert grand piano 1*a*. The user firstly depresses one of the eighty-eight keys such as the leftmost key assigned the note number "21". The depressed key actuates the associated action unit 1*d*, and the hammer 1*e* is driven for rotation by the actuated action unit 1*d*. The hammer strikes the associated string 1*f*, and gives rise to vibrations. Then, the acoustic piano tone G# is generated from the vibrating string 1*f* and sound board 1*g*.

The acoustic piano tone G# is propagated to the microphones 2, 3 and 4, and the acoustic wave is converted to the electric signals through the microphones 2, 3 and 4 until the acoustic piano tone G# is perfectly decayed. The electric signals are supplied from the microphones 2, 3 and 4 to the recorder 5, and the recorder 5 stores the three series of pieces of waveform data in three data files of the data holder. The three data files form in combination a data sub-holder assigned to the set of waveform data series representative of the acoustic piano tone G#.

Subsequently, the user depresses the next key such as the key assigned the note number "22", and the acoustic piano tone A is generated from the vibrating string 1*f* and sound board 1*g*. The microphones 2, 3 and 4 convert the acoustic wave to the electric signals until the acoustic piano tone A is perfectly decayed. The recorder 5 samples the discrete values on the electric signals, and stores the set of waveform data series in the next data sub-holder.

The user repeats the keying-in, and stores the sets of waveform data series in other data sub-holders for the remaining acoustic piano tones. When the recorder 5 stores the set of waveform data series in the last data sub-holder assigned the acoustic tone corresponding to the rightmost key, the group of waveform data sets is completed in the data holder for the set of acoustic piano tones. The pieces of positional data representative of the recording points L, M and R are further stored in the data holder. In case where the user wishes to create another data holder for acoustic tones different in timbre from the acoustic piano tones, the user further stores the piece of tone color data in the data holder, and makes the data holder accessible with an address representative of the timbre of the acoustic piano tones. In this instance, the data holder is stored in a hard disc. The hard disc is easily taken out from the recorder 5, and is loaded into the data processing system 10*b*.

Assuming now that the data holder has been already transferred to the data processing system 10*b*, the user can produces the electronic tones close in impression to the acoustic piano tones by fingering on the keyboard 10*a*. While the user is fingering on the keyboard 10*a*, he or she is assumed to depress the key assigned the note number "31". When the data processing system 10*b* acknowledges the depressed key "31", the data processing system 10*b* starts to read out the plural series of pieces of waveform data from the three files of the corresponding data sub-holder in parallel, and produces the audio signals representative of the electronic tone C. The audio signal to be supplied to the loud speaker 32 is modified with the pieces of control data such that the electronic tone C is a little delayed and/or reduced in loudness. The data processing system 10*b* supplies the audio signal representative of the acoustic piano tone C recorded through the microphone 2 through the amplifier 10*e* to the loud speaker 31, the audio signal representative of the acoustic piano tone C recorded through the microphone 3 through the amplifier 10*e* to the loud speaker 32 and the audio signal representative of the acoustic piano tone C recorded through the microphone 4 through the amplifier 10*e* to the loud speaker 33. The impression of electronic tones on the ears is substantially identical with that of the acoustic piano tones by virtue of the timing control and/or the volume control.

Although the impression of electronic tones is same as the impression of electronic tones produced through the prior art multi-channel sampled data storage type electronic keyboard instrument, the multi-channel sampled data storage type electronic keyboard instrument according to the present invention is less bulky rather than the prior art multi-channel sampled data storage type electronic keyboard instrument. Thus, the objects of the present invention are accomplished by the recording system 1 and electronic musical instrument 10 shown in FIGS. 1A and 1B.

System Configuration of Recorder

Figure 2:
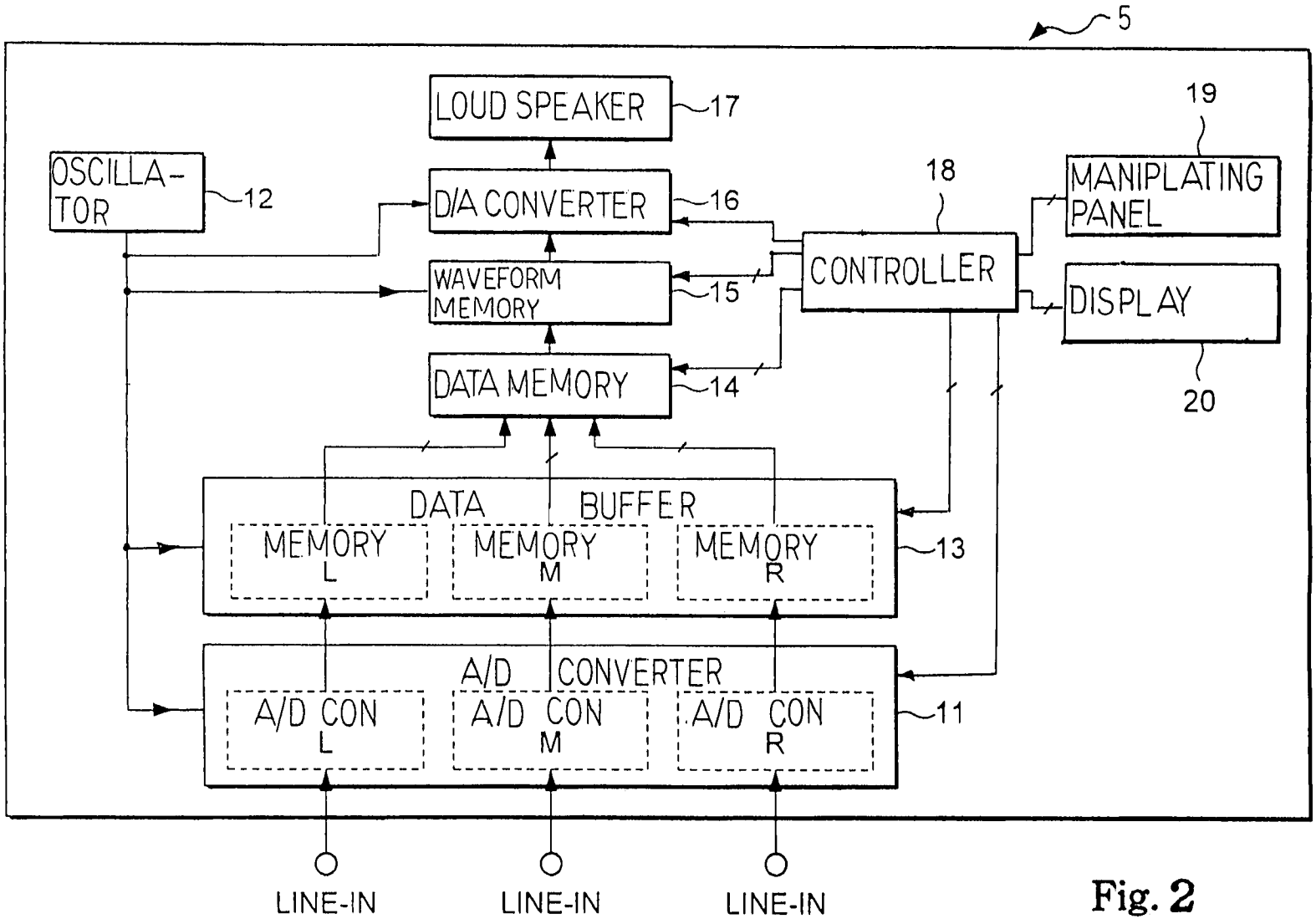
FIG. 2 is a block diagram showing the system configuration of a recorder incorporated in the recording system.

FIG. 2 shows essential system components of the recorder 5. The recorder 5 includes an analog-to-digital converter 11, an oscillator 12, a data buffer 13, a data memory 14, a waveform memory 15, a digital-to-analog converter 16, a loud speaker 17, a controller 18, a manipulating panel 19 and a display unit 20. The controller 18 supervises the other system components 11-17, 19 and 20, and controls them to create the data holder or holders in the data memory 14. When the user wants to confirm the electronic tone, the controller 18 requests the data memory 14 to transfer a series of pieces of waveform memory from the data memory 14 to the waveform memory 15, and reproduces the electronic tone through the digital-to-analog converter 16 and loud speaker 17.

The controller 18 includes a microprocessor, a program memory, a working memory and a DMA (Direct Memory Access) controller, and these components are connected through a bus system to one another. The program memory includes an electrically erasable and programmable memory, and another sort of non-volatile memory, and instruction codes are stored in the electrically erasable and programmable memory for a main routine program and sub-routine programs. Control parameters are stored in the other sort of non-volatile memory. The microprocessor sequentially fetches instruction codes, and achieves tasks described hereinlater in detail. The DMA controller is used in a data transfer from the data buffer 13 to the data memory 14.

The manipulating panel 19 has button switches, ten keys and sliders, which are hereinafter simply referred to as "switches". Users give instructions through the switches, and make their option also through the switches. The microprocessor periodically checks the manipulating panel through the main routine program to see whether or not a user gives an instruction or makes the option. When the microprocessor acknowledges the instruction or option, the microprocessor branches to the subroutine program, and achieves the given task. The user inputs the pieces of positional data representative of the recording points L, M and R and the piece of tone color data representative of the timbre of acoustic tones by manipulating the switches.

The display unit 20 includes a video random access memory, a liquid crystal display panel and a driving circuit for the liquid crystal display panel. When the microprocessor decides to produce visual images such as, for example, characters and/or symbols on the liquid crystal display penal, the microprocessor writes pieces of visual data representative of the characters and or symbols in the video random access memory, and requests the driver circuit to produce the characters and/or symbols on the liquid crystal display panel. The driver circuit accesses the pieces of visual data, and produces the character/symbol images on the liquid crystal display panel. The microprocessor prompts the user to input an instruction or option through the manipulating panel 19, and the user confirms his or her instruction and/or option on the liquid crystal display panel.

The oscillator 12 generates a clock signal at 48 kHz, and supplies it to the analog-to-digital converter II and waveform memory 15.

The analog-to-digital converter 11 includes three analog-to-digital converting circuits L, M and R. The electric signals are supplied in parallel from the microphones 2, 3 and 4 to the analog-to-digital converting circuits L, M and R, and carry out the analog-to-digital conversion on the electric signals, respectively. The function of the analog-to-digital conversion is common to those analog-to-digital converting circuits L, M and R so that only the analog-to-digital converting circuit L is described in detail.

The analog-to-digital converting circuit L includes an amplifier, a low pass filter and a converter. The analog-to-digital converting circuit L starts the analog-to-digital conversion upon reception of a control signal supplied from the controller 18, and stops the analog-to-digital conversion at arrival of a control signal representative of the entry into the idling state. Various sorts of circuit configurations are known to persons skilled in the art, and any sort of converter is available for the analog-to-digital conversion on the electric signal. The microphone 2 is assumed to convert an acoustic piano tone to the electric signal. The electric signal is supplied from the microphone 2 to the amplifier, and is amplified through the amplifier. The controller 18 supplies a volume control signal to the amplifier, and the amplifier varies the gain depending upon the target volume. If the volume is to be reduced, the amplifier changes the gain to a certain value less than 1. On the other hand, if the volume is to be increased, the amplifier changes the gain to a certain value greater than 1.

After the amplification, the electric signal is supplied to the low pass filter, and high-frequency noise components, which are higher than 20 kHz, are eliminated from the electric signal. The elimination of high-frequency noise components is effective against the aliasing noise at the digital-to-analog conversion. The reason why the high-frequency noise components are to be eliminated from the electric signal is well know to persons skilled in the field of pulse width modulation technologies, and no further description is incorporated hereinafter for the sake of simplicity.

After the elimination of the high frequency noise components from the electric signal, the electric signal is supplied to the converter. The converter is responsive to the clock signal, and samples the discrete values of the magnitude at regular intervals of $1/48000$ second. A binary number is assigned to each discrete value. The binary number is selected from the range between −8388608 and +8388608. Thus, the resolution at the analog-to-digital conversion is $2^{24}$. Thus, the discrete values are converted to a series of 24-bit data, and the 24-bit data is stored in a data field of a data code. In this instance, the series of data codes is corresponding to the series of pieces of waveform data, and is representative of the waveform of an acoustic piano tone. While the discrete values are less than a threshold value, the converter does not transfer the data codes to the data buffer 13. When a discrete value exceeds the threshold value, the converter starts to supply the data codes or the series of pieces of waveform data to the data buffer 13. When the controller 18 supplies the control signal representative of the entry into the idling state, the analog-to-digital converting circuit L stops the operation.

The data buffer 13 includes three memory units L, M and R. The memory units L, M and R are respectively associated with the analog-to-digital converting circuit L, M and R, and the plural series of data codes are respectively supplied from the analog-to-digital converting circuits L, M and R to the memory units L, M and R synchronously with the sampling. Upon completion of the analog-to-digital conversion, a series of data codes, i.e., a series of pieces of waveform data is stored in the associated memory unit L, M or R.

The memory units L, M and R are similar in system configuration to one another, and only the memory unit L is hereinafter described in more detail for the sake of simplicity. The memory unit L includes a write-in circuit, a volatile memory such as, for example, a random access memory, a read-out circuit and an address pointer. The controller 18 supplies a read-write control signal to the volatile memory so as to change it between a write-in mode and a read-out mode. When the discrete value exceeds the threshold value, the converter, which forms the part of the analog-to-digital converting circuit L, resets the address pointer, and the address pointer increments the address synchronously with the clock signal, which is supplied from the oscillator 12. The write-in circuit temporarily stores the data code, and writes the piece of waveform data in the address presently designated by the address pointer. On the other hand, when the analog-to-digital conversion is completed, the controller 18 changes the volatile memory to the read-out mode with the read/write control signal, and starts to supply the read-out address from the DMA controller to the volatile memory. The read-out address is sequentially changed so that the series of data codes are transferred from the read-out circuit to the data memory 14.

Figure 3:
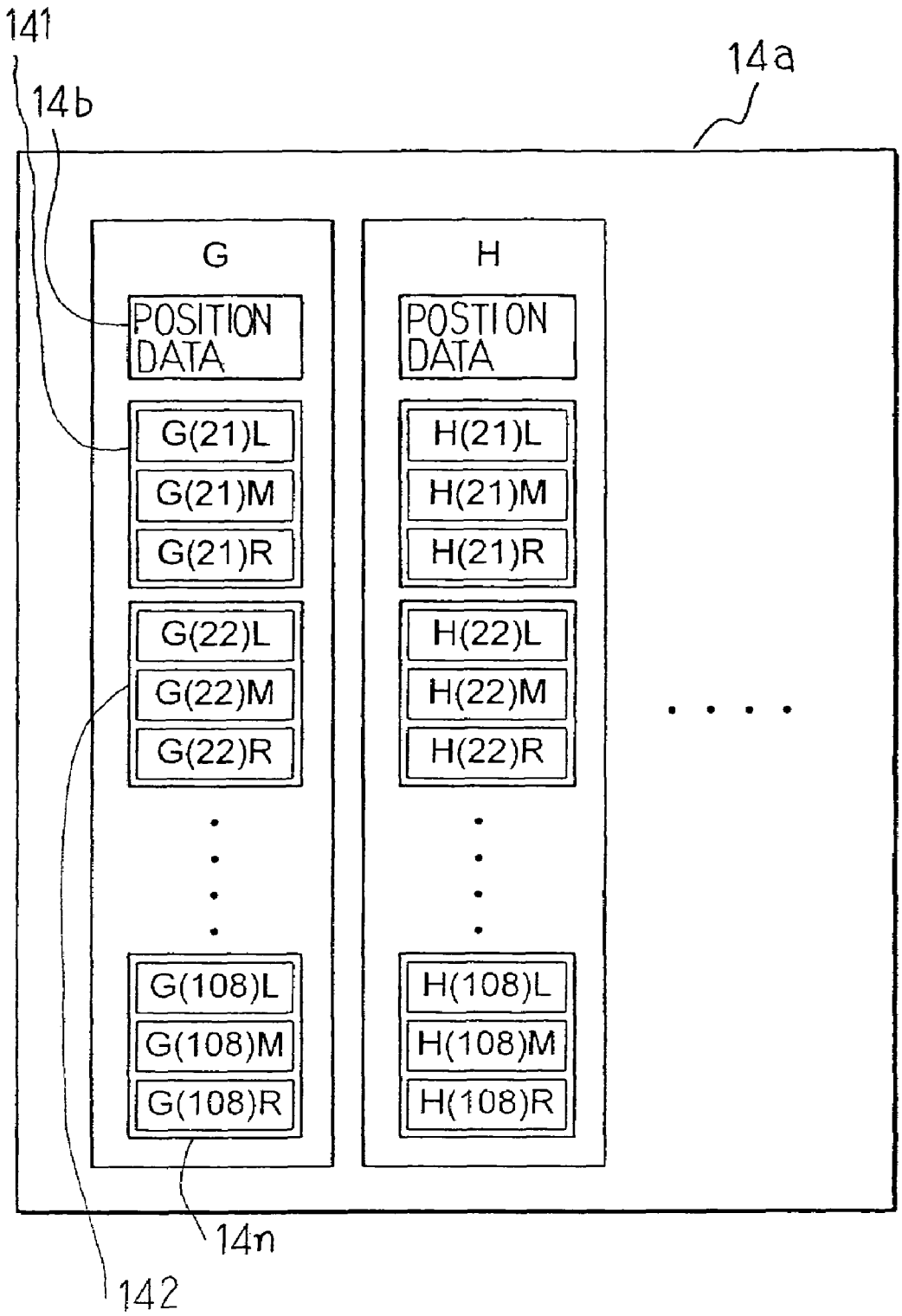
FIG. 3 is a view showing contents stored in a data memory forming a part of the recorder.

The data memory 14 includes a hard disc drive, a write-in circuit and a read-out circuit, and creates the data holder in a magnetic disc 14*a* (see FIG. 3). The hard disc drive is of a removable type, viz., of the type easily removed from the data memory 14. As described hereinbefore in conjunction with the data buffer 13, the series of data codes are sequentially supplied from the memory units L, M and R, and the plural sets of memory data sets are stored in the data holder created in the magnetic disc together with the pieces of positional data and piece of tone color data.

FIG. 3 shows contents stored in the magnetic disc 14*a*. The data holders are labeled with tone color codes "G", "A", . . . , and are accessible by using the tone color code as the address. When the user specifies the timbre of acoustic piano tones through the manipulating panel 19, the controller 18 assigns the address, i.e., the tone color code to the data holder. In this instance, the tone color code "G" is representative of the piece of tone color data, i.e., the timbre of the concert grand piano 1*a*, and the tone color code "G" is assigned the data holder for the group of waveform data sets. When the user gives the pieces of positional data representative of the recording points L, M and R to the controller 18 through the manipulating panel 19, the pieces of positional data 14*b* are stored in the data holder G.

The data holder G includes plural data sub-holders 141, 142, . . . and 14*n*, and the sub-holders 141, 142, . . . and 14*n* are respectively assigned to the sets of waveform data series for the eighty-eight acoustic piano tones. The note numbers "21", "22", . . . "108" are respectively assigned to the sub-holders, and the sets of waveform data series are selectively accessible with the note numbers "21", 22, . . . and "108". Thus, the note numbers serves as the addresses assigned to the sub-holders. Three files are incorporated in each sub-holder "21", "22", . . . or "108", and are assigned to the three series of pieces of waveform data recorded at the three recording points L, M and R. The file L is assigned to the series of pieces of waveform data recorded through the microphone 2. Similarly, the files M and R are respectively assigned to two series of pieces of waveform data recorded through the microphone 3 and 4.

The note numbers "21", "22", . . . "108" are identical with those defined in the MIDI standards.

Assuming now that the user notifies the controller 18 of the note number "21" assigned to the acoustic piano tone to be stored in the data holder "G", the controller assigns the sub-holder "21" to the acoustic piano tone. When the note number "21" reaches the data memory 14, the write-in circuit assigns the address "21" to a sub-holder 141, and the three files L, M and R are respectively assigned to plural series of data codes. Upon completion of the preparing work, the data memory 14 notifies the memory units L, M and R of the completion of the preparing work, and waits for the plural series of data codes.

When the user depresses the key, the acoustic piano tone is generated from the string 1*f* and sound board 1*g*, and is converted to the electric signals at the recording points L, M and R. The analog-to-digital converting circuits L, M and R starts to sample the discrete values on the electric signals and convert the discrete values to the data codes. The three series of data codes are sequentially stored in the memory units L, M and R, respectively.

The DMA controller supplies the read-out address to selected one of the memory units L, M and R, and the series of data codes is transferred to the data memory 14. The write-in circuit stores one of the three series of data codes in the associated file L, M or R of the sub-holder 141. When the write-in circuit writes the last data code in the file, the write-in circuit supplies a control signal representative of the completion of the write-in operation to the memory unit L, M or R, and prompts the next memory unit M, R or L to transfer the series of data codes to the write-in circuit. The write-in circuit sequentially stores the next series of data codes in the associated file M, R or L. Thus, the write-in circuit repeats the write-in operation on the plural series of data codes, and stores the three series of data codes in the associated files L, M and R. Upon completion of the write-in operation, the write-in circuit stores a piece of sector data for reading out the series of data codes in the magnetic disc, and closes the three files.

The recorder 5 repeats the above-described write-in sequence for other acoustic piano tones "22" to "108", and completes the data holder G. If the user wishes to stores acoustic tones in another timbre H, the user repeats the write-in sequence, again, and a group of waveform data sets is stored in the data holder H together with pieces of positional data representative of the recording points. The read-out circuit will be described hereinafter in conjunction with the waveform memory 15.

The waveform memory 15 includes a write-in circuit, a volatile memory such as, for example, a random access memory and a read-out circuit. The write-in circuit cooperates with the read-out circuit of the data memory 14, and transfers a series of data codes, which represents the series of pieces of waveform data, from the volatile memory of the data memory 14 to the volatile memory of the waveform memory 15. In detail, when the user wants to confirm the electronic tone, the controller 18 instructs the data memory 14 to transfer the series of data codes to the waveform memory 15. The controller 18 notifies the read-out circuit of the data memory 14 and the write-in circuit of the waveform memory 15 of a holder address, a sub-holder address and a file address, and the controller 18 sequentially supplies the physical address to the waveform memory 15 through the DMA controller. For example, when the controller 18 transmits the file G(21)L (see FIG. 3) from the data memory 14 to the waveform memory 15, the controller 18 specifies the data holder, sub-holder and file with the holder address "G", sub-holder address "21" and file address L, and the physical addresses are supplied from the DMA controller to the waveform memory 15 for writing the pieces of waveform data in the volatile memory. The pieces of waveform data are sequentially read out from the file G(21)L in the data memory 14, and are transferred to the waveform memory 15. The write-in circuit stores the series of data codes in the waveform memory 15.

The read-out circuit of the waveform memory 15 is responsive to the clock signal so as to transfer the series of data codes from the file G(21)L to the digital-to-analog converter 16. When the write-in circuit completes the write-in operation on the waveform memory 15, the write-in circuit notifies the read-out circuit of the completion of the data write-in, and the read-out circuit sequentially reads out the pieces of waveform data from the waveform memory 15 at the regular intervals of $1/48000$ second. The pieces of waveform data are supplied from the waveform memory 15 to the digital-to-analog converter 16, and the digital-to-analog converter 16 reproduces the analog audio signal from the series of data codes. The audio signal is supplied to the loud speaker 17, and is converted to the electronic tone "21".

If the user specifies another file such as G(21)M or G(21)R, the series of data codes is transferred to the waveform memory 15, and, thereafter, are read out from the waveform memory 15 synchronously with the clock signal so that the user confirms the electronic tone through the loud speaker 17.

In case where the user stops the reproduction of the electronic tone, the controller 18 supplies a control signal representative of the interruption to the waveform memory 15. Then, the read-out circuit stops the data transfer to the digital-to-analog converter 16, and the series of data code is erased from the volatile memory of the waveform memory 15.

The digital-to-analog converter 16 includes a converter, a low pass filter and an amplifier. The data codes are input to the converter at the time intervals of $1/48000$ second, and are restored to an analog audio signal analogous to the original analog audio signal. High-frequency noise components higher than 20 kHz are eliminated from the analog audio signal, and, thereafter, the analog audio signal is supplied from the low pass filter to the amplifier. The analog audio signal is amplified, and, thereafter, is supplied to the loud speaker. The controller 18 gives a control signal representative of the amplification factor to the amplifier depending upon the position of the volume switch on the manipulating panel 19. The loud speaker 17 is of the type having a diaphragm and a voice coil, and radiate the electronic tones to the air.

Recording

Figure 4:
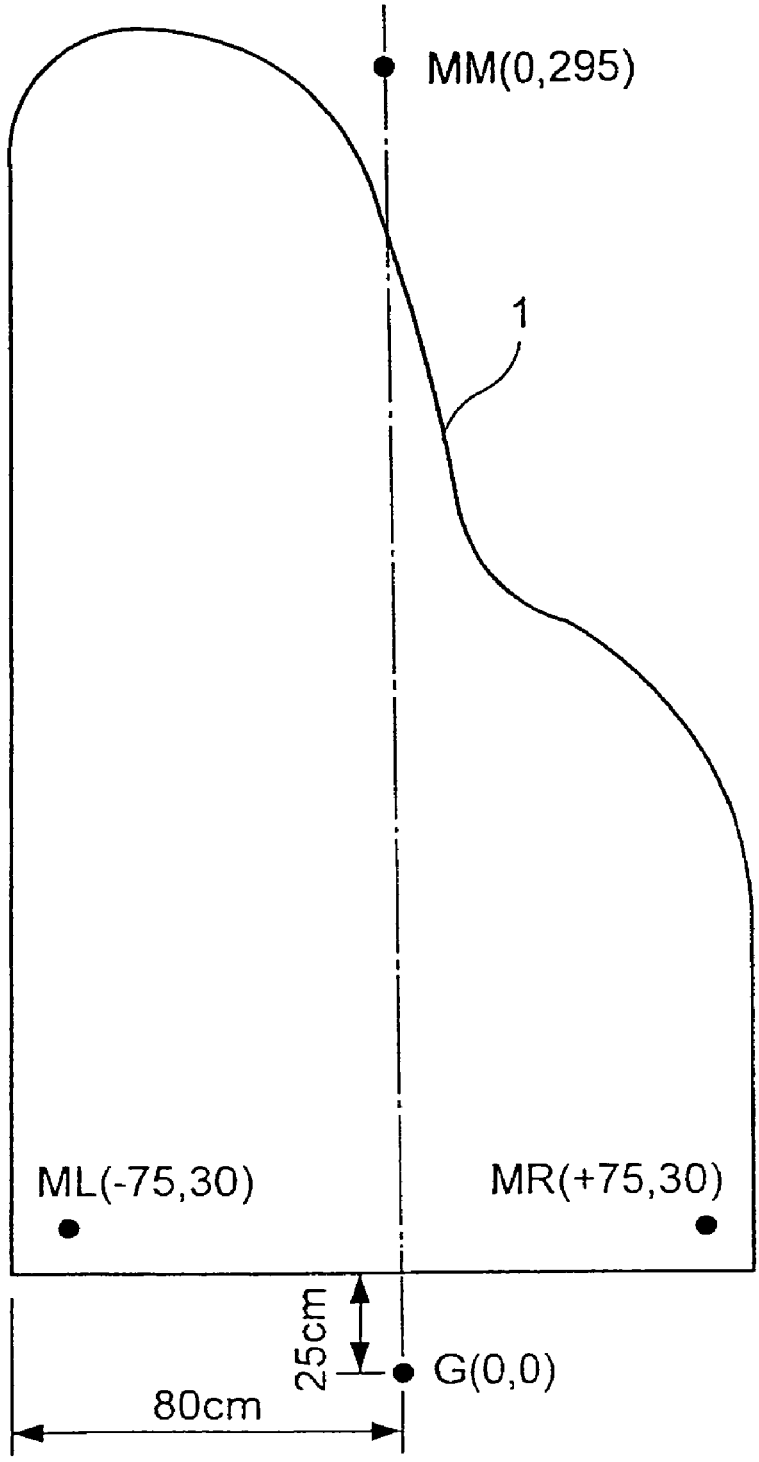
FIG. 4 is a plane view showing the recording points on a concert grand piano.

The user records the acoustic piano tones as follows. Firstly, the user inputs the piece of tone color data and pieces of positional data representative of the recording points through the manipulating panel 19. FIG. 4 illustrates coordinates representative of the recording points in the orthogonal coordinate system. The pianist is assumed to sit at the origin of the orthogonal coordinate system, and coordinate (0, 0) is given to the point G occupied by the pianist. The distance between the pianist and the left sideline is 80 centimeters, and the pianist is spaced from the front end line by 25 centimeters. As shown in FIG. 1A, the left microphone 2 is spaced from the left sideline by 5 centimeters and from the front end line by 5 centimeters so that the left microphone 2 is plotted at ML (−75, 30). The right sideline is spaced from the origin G by 80 centimeters, and the right microphone 4 is spaced from the right sideline by 5 centimeters and from the front end line by 5 centimeters.

The right microphone 4 is plotted at MR (+75, 30). The center microphone 3 is plotted at MM (0, 295).

The recording points ML, MM and MR are variable depending upon the acoustic musical instrument. If the user records the acoustic piano tone generated through a standard grand piano, the recording points ML, MM and MR are differently plotted in the orthogonal coordinate system. Another user may put the stool at a point G' spaced from the point G. Nevertheless, the point G' is still the origin of the orthogonal coordinate system.

In this instance, the user inputs the piece of tone color data representative of the timbre of acoustic piano tones "G" and pieces of positional data representative of the recording points ML (−75, 30), MM (0, 295) and MR (+75, 30) through the manipulating panel 19 to the controller 18.

When the controller 18 acknowledges the piece of tone color data G and pieces of positional data ML, MM and MR, the controller 18 requests the data memory 14 to creates a new data holder at address "G", and the write-in circuit of the data memory 14 writes the pieces of positional data ML (−75, 30), MM (0, 295) and MR (+75, 30) in the data holder "G".

Subsequently, the user notifies the controller 18 of the pitch name "21" of the acoustic piano tone to be recorded through the manipulating panel 19. Then, the controller 18 prepares a sub-holder 141 containing three files G(21)L, G(21)M and G(21)R in the data memory 14. When the data memory 14 creates the sub-holder 141, the data memory 14 enters into the ready-for-recording state, and notifies the data buffer 13 of the entry into the ready-for-recording state.

The user requests the controller 18 to record the acoustic piano tone by depressing the start switch on the manipulating panel 19. Although the analog-to-digital converting circuits L, M and R have started the analog-to-digital conversion at the power-on, the analog-to-digital converting circuits L, M and R do not output the data codes to the data buffer 13. When the controller 18 supplies the control signal representative of the initiation of the recording to the analog-to-digital converter 11 and the data buffer 13, The analog-to-digital converting circuits L, M and R enter the ready-for-recording state, and the address pointer is set to the initial physical address.

Upon completion of the preparatory work, the user depresses the key of the keyboard 1*c* so that the concert grand piano 1*a* generates the acoustic piano tone "21", and the acoustic piano tone "21" is converted to the electric signals through the microphones 2, 3 and 4. The microphones 2, 3 and 4 wave the electric signals, and the waveforms are delicately different from one another depending upon the recording points ML, MM and MR.

The electric signals reach the analog-to-digital converting circuits L, M and R, respectively. The analog-to-digital converting circuits L, M and R are sampled at the regular intervals of $1/48000$ second, and the discrete values of the magnitude are converted to the data codes. When the discrete values exceed the threshold value, the analog-to-digital converting circuits L, M and R starts to transfer the data codes to the associated memory units L, M and R, and the address pointer starts to increment the physical address synchronously with the clock signal. Thus, the plural series of data codes or plural series of pieces of waveform data are stored in the memory units L, M and R, respectively.

When the acoustic piano tone "21" is decayed, the user notifies the controller 18 of the completion of the recording through the manipulating panel 19, and the controller 18 supplies the control signal representative of the completion of the recording to the analog-to-digital converter 11, data buffer 13 and data memory 14. The analog-to-digital converting circuits L, M and R stop the data transfer to the data buffer 13. The controller 18 supplies the address signal to the memory units L, M and R and waveform memory 15, and the memory units L, M and R sequentially transfer the plural series of data codes to the associated files G(21)L, G(21)M and G(21)R. When the write-in circuit of the data memory 14 receives the last data code representative of the end of the series from the read-out circuit of the associated memory unit L/M/R, the write-in circuit stores the last data code in the file G(21)L/G(21)M/G(21)R, and close the file. The data buffer 13 repeats the data transfer to the data memory 14 for the other series of data codes. When the three series of data codes are stored in the files G(21)L, G(21)M and G(21)R, the controller 18 closes the sub-holder 141, and notifies the user of the completion of the data transfer through the display 20.

The user may want to confirm the electronic tone produced from the series of data codes. If so, the user instructs the controller 18 to transfer the series of pieces of waveform data in a file G(21)L, G(21)M and G(21)R from the data memory 14 to the waveform memory 15 through the manipulating panel 19. The user specifies the file with the holder address, sub-holder address and the file address "L", "M" or "R". When the user wishes to reproduce the electronic tone from the series of data codes stored in the file G(21)L, the user inputs the holder address "G", sub-holder address "21" and file address "L" through the manipulating panel 19. The controller 18 requests the data memory 14 to transfer the series of data codes from the file G(21)L to the waveform memory 15, and sequentially increments the physical address supplied to the waveform memory 15. Then, the series of data codes is stored in the waveform memory 15. Upon completion of the data transfer, the controller 18 requests the waveform memory 15 to transfer the series of data codes to the digital-to-analog converter 16. The read-out address is incremented with the clock signal supplied from the oscillator 12, and the data codes are supplied from the waveform memory 15 to the digital-to-analog converter 16. The discrete values are restored to the analog audio signal, and the analog audio signal is converted to the electronic tone through the loud speaker 17. Thus, the user confirms the electronic tone. When the user feels the electronic tone too small in loudness, the user instructs the controller 18 to increase the loudness, and the controller 18 increases the amplification factor of the amplifier incorporated in the digital-to-analog converter 16. If, on the other hand, the user feels the electronic tone too loud, the user instructs the controller 18 to decrease the loudness, and the controller 18 changes the amplification factor to a small value. Thus, the user can confirm the electronic tone at a proper loudness.

If the user does not request the recorder 5 to reproduce the electronic tone, the user inputs the next key number "22" through the manipulating panel 19, and the controller 18 stores a set of waveform data series in the next sub-holder 142. The above-described recording sequence is repeated for other acoustic piano tones, and a group of waveform data sets is finally stored in the data holder G.

System Configuration of Electronic Musical Instrument

Figure 5:
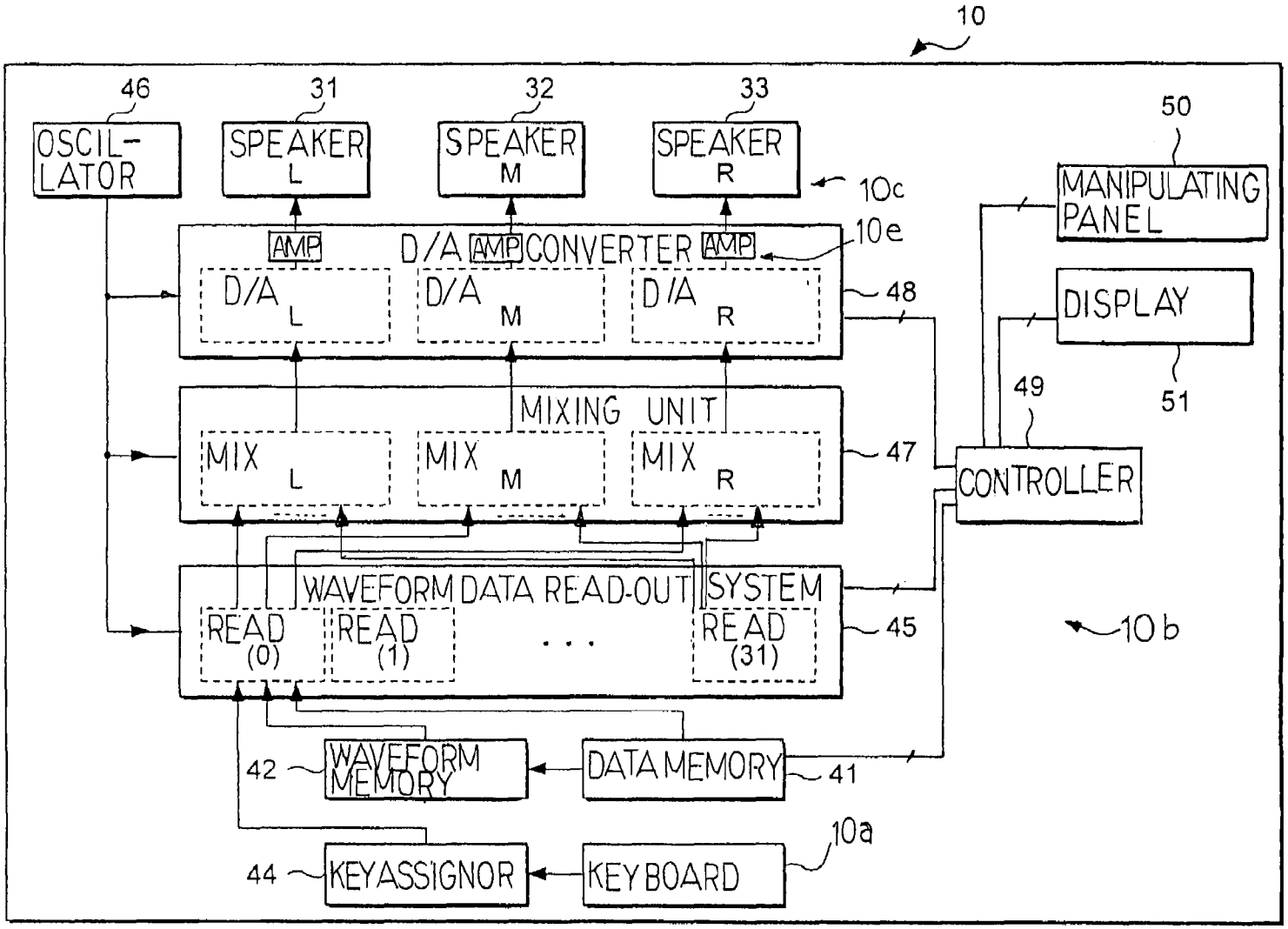
FIG. 5 is a block diagram showing the system configuration of the electronic musical instrument.

Turning to FIG. 5 of the drawings, the multi-channel sampled data storage type electronic keyboard 10 largely comprises the keyboard 10*a*, data processing system 10*b* and the sound system 10*c*. The keyboard 10*a* and sound system 10*c* have been already described with reference to FIG. 1B so that description is focused on the data processing system 10*b*.

The data processing system 10*b* includes a data memory 41, a waveform memory 42, a key assignor 44, a waveform data read-out system 45, an oscillator 46, a mixing unit 47, a digital-to-analog converting unit 48, a controller 49, a manipulating panel 50 and a display 51. The controller 49 supervises the other system components for generating electronic tones. The controller 49, manipulating panel 50 and display 51 are similar in system configuration to the controller 18, manipulating panel 19 and display 20, respectively. The controller 49 includes a microprocessor, a program memory and a working memory. The microprocessor sequentially fetches instruction codes from the program memory so as to repeatedly execute a main routine program. While the microprocessor is reiterating the main routine program, the microprocessor checks the manipulating panel 50 to see whether user gives a new instruction.

If the answer is given affirmative, the main routine program selectively branches to sub-routine programs. The microprocessor requests the display 51 to reproduce character images and/or symbols on a liquid crystal display panel for the user. Thus, the user and controller 49 communicate with one another through the manipulating panel 50 and display 51.

The oscillator generates a clock signal at 48 kHz, and supplies the clock signal to the waveform data read-out system 45 and mixing unit 47.

The data memory 41 includes a hard disc drive and a read-out circuit. The data holder or holders are stored in the magnetic disc of the hard disc drive. The hard disc drive is of the removable type. The read-out circuit transfers the sets of waveform data series from the magnetic disc to the waveform memory 42.

Figures 6, 7, 8:
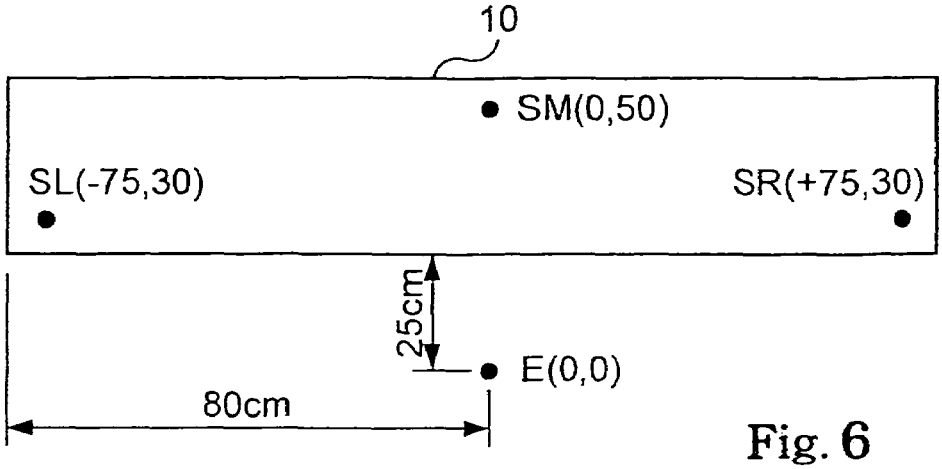
FIG. 6 is a plane view showing tone radiating points on a multi-channel sampled data storage type electronic keyboard.
FIG. 7 is a view showing a format of a key data code supplied to a key assignor.
FIG. 8 is a view showing an assign list created in the key assignor.

The group of waveform data sets is stored in each data holder together with the pieces of positional data representative of the recording points ML, MM and M. When the removable hard disc is loaded into the data memory 41, the controller 49 prompts the user to input pieces of positional data representative of the tone radiating points. The user inputs the pieces of positional data representative of the tone radiating points SL, SM and SR. Then, the controller 49 transfers the pieces of position data to the hard disc drive, and the pieces of position data are stored in the magnetic disc. In this instance, the pieces of positional data are given as coordinates in the orthogonal coordinate system The player is assumed to sit at the origin E(0, 0) of the orthogonal coordinate system as shown in FIG. 6. The tone radiating points SL, SM and SR are plotted in the orthogonal coordinate system, and coordinates (−75, 30), (0, 50) and (+75, 30) are given to the tone radiating points SL, SM and SR, respectively. The user can change the pieces of tone radiating points SL, SM and SR through the manipulating panel 50. The user may put the microphones 31, 32 and 33 at different tone radiating points SL, SM and SR for another acoustic musical instrument. For this reason, the pieces of positional data are stored in each data holder.

When the read-out circuit of the data memory 41 receives the tone color code or data holder address from the controller 49, the read-out circuit transfers the pieces of positional data representative of the tone radiating points SL, SM and SR to read-out units of the waveform data read-out system 45 and the group of waveform data sets from the data holder to the waveform memory 42. Upon completion of the data transfer to the waveform memory 42, the read-out circuit notifies the controller 49 of the completion of the data transfer.

The waveform memory 42 includes a high-speed volatile memory and a write-in circuit. The write-in circuit cooperates with the read-out circuit of the data memory 41, and writes the plural series of pieces of waveform data into the high-speed volatile memory.

The keyboard 10*a* includes eighty-eight keys, a data processor and plural combinations of photo radiators and photo sensors. The plural combinations of photo radiators/photo sensors respectively monitor the eighty-eight keys, and convert the current key positions of the associated keys to key position signals. The key position signals are supplied to the data processor, and the data processor determines the key velocity/the magnitude of force exerted on the key on the basis of the trajectory of the depressed key. The data processor detects the depressed key at the end position and the released key at the rest position, and supplies a 15-bit key data code representative of a note-on and another 15-bit key data code representative of a note-off to the key assignor 44.

FIG. 7 shows the format for the 15-bit key data code. The 15 bit key data code is broken down in to three data fields. The first data field is only one bit k(0), and bit k(0) is representative of a direction in which the key is moved. When bit k(0) has value "1", the bit k(0) is representative of the key downwardly moved. On the other hand, if bit k(0) has value "0", the bit k(0) is representative of the key upwardly moved. The second data field has seven bits, i.e., n(0) to n(6). The second data field is representative of the pitch name "21" to "108". The third data field also has seven bits, i.e., v(0) to v(6), and represents the key velocity/force exerted on the depressed key. The resolution to the force is 128. Of course, when bit k(0) is zero, bits v(0) to v(6) is also zero. The key data code shown in FIG. 7 represents that the tone to be generated is "C", i.e., the pitch name "60" and that the force "100" is exerted on the key.

The key assignor 44 assigns one of the read-out units of the waveform data read-out system 45 to each key data code for sequentially reading out the series of data codes from the waveform memory 42. Since the waveform data read-out system has thirty-two read-out units (0)-(31), the key assigner can concurrently assign the thirty-two read-out units to thirty-two key data codes. This means that the waveform data read-out system 45 can concurrently read out thirty-two series of data codes from the waveform memory.

The key assignor 44 includes a write-in circuit, a volatile memory and a distributor. When the key data code arrives at the write-in circuit, the write-in circuit writes the key data code in the volatile memory, and the key data code enters a queue which the key data codes have already made.

An assign list is created in a high-speed volatile memory incorporated in the distributor, and the thirty-two read-out units (0) to (31) are correlated with the tones indicated by the key data codes on the assign list. FIG. 8 shows the assign list. The assign list includes thirty-two rows, and each row has three data fields. The first data field consists of 5 bits, i.e., a(0) to a(4), and the 5-bits a(0) to a(4) are indicative of the number assigned to the read-out units, i.e., "0" to "31". The second data field consists of one bit b(0), and is indicative of the current status of the read-out circuits. If the key has been already assigned to the read-out unit, the status bit b(0) is "1". On the other hand, if the status bit b(0) is zero, the read-out unit stands idle, and is assignable to a newly depressed key. The third data field consists of 7 bits, i.e., c(0) to c(6), and is indicative of the pitch name, i.e., "21" to "108". The piece of data information stored in each row is hereinafter referred to as "key assign data code". The assign list is periodically rewritten with the lapse of time. The key assign data codes with the status bit of "1" are stored in the rows smaller in number than the rows in which the key assign data codes with the status bit of "0" are stored. The smaller the row number, the later the key assignment. Thus, the latest key assign data code is always stored in the first row "0".

The distributor periodically checks the volatile memory to see whether or not the queue has been already made. When the distributor finds at least one key data code in the volatile memory, the distributor reads out the key data code at the head of the cur, and erases the key data code from the cur. The distributor compares the key data code with the contents of the assign list to see whether or not the key data code is to be registered in the assign list as follows.

First, the distributor checks the key data code to see whether the bit k(0) is indicative of the note-on or note-off. If the bit k(0) is 1 representative of the note-on, the distributor checks the assign list to see whether or not the pitch name n(0)-n(6) has been already assigned any read-out unit. If the distributor finds the pitch name n(0)-n(6) to have been not assigned any read-out unit, yet, the distributor assigns the idling read-out unit to the newly depressed key, and transfers the second data field n(0)-n(6) and third data filed v(0)-v(6) to the idling read-out unit. Subsequently, the distributor rewrites the assign list such that the read-out unit just assigned the depressed key occupies the first row "0", and writes the pitch name indicated by the second data field n(0) to n(6) into the third data field c(0) to c(6) of the first row "0" Finally, the status bit b(0) is changed to 1.

On the other hand, if bit k(0) of the key data code is zero, the user has already released the key from the depressed state. The distributor checks the assign list to see what read-out unit has been assigned the pitch name n(0)n-(6). When the distributor finds the read-out unit assigned to the pitch name, the distributor reads out the number a(0) to a(4) indicative of the read-out unit, and supplies a control signal representative of the decay of the electronic tone to the read-out unit indicated by the bits a(0)-a(4). Subsequently, the distributor changes the status bit b(0) to zero, and zero is written into the third data field c(0)-c(6). Then, the distributor moves the assign data code with the status bit b(0) just changed to zero to a row larger in number than the rows assigned the assign data codes with the status bit b(0) of 1.

The waveform data read-out system 45 concurrently reads out plural sets of waveform data series from the waveform memory 42, and transfers the digital audio signals, i.e., the sets of waveform data series through the mixing unit 47 to the digital-to-analog converter 48.

The waveform data read-out system 45 includes the thirty-two read-out units (0) to (31), and the second data field n(0)-n(6) and third data filed v(0)-v(6) are supplied from the key assigner 44 to each of the read-out units (0)-(31). Each read-out unit successively reads out the set of waveform data series for the tone with the pitch name n(0)-n(6) at the loudness indicated by the third data field v(0)-v(6), and modifies the series of pieces of waveform data with the pieces of control data on the basis of the pieces of positional data representative of the recording points and the tone radiating points. This means that the multi-channel sampled data storage type electronic keyboard 10 can concurrently generate thirty-two electronic tones at the maximum. The thirty-two read-out units are similar in configuration and function to one another so that description is focused on one of the read-out units (0).

When the user specifies the timbre of electronic tones to be generated, the data memory 41 supplies the pieces of positional data representative of the recording points ML, MM and MR, which are stored in the specified data holder, and pieces of positional data representative of the tone radiating points SL, SM and SR to the read-out units (0)-(31). The read-out units (0)-(31) determines delay parameters and volume parameters on the basis of the pieces of positional data representative of the recording points ML, MM and MR and pieces of positional data representative of the tone radiating points SL, SM and SR. In this instance, the delay parameters and volume parameters serve as the pieces of control data.

The read-out unit (0) produces the delay parameters and volume parameters from the pieces of positional data representative of the recording points ML, MM and MR and pieces of positional data representative of the tone radiating points SL, SM and SR as follows. Note the following method is the simplest example, and persons skilled in the art will produce the delay parameters and volume parameters through another method.

The recording position ML, MM and MR are respectively plotted at (−75, 30), (0, 295) and (+75, 30) in the orthogonal coordinates, and the tone radiating points SL, SM and SR are respectively plotted at (−75, 30), (0, 50) and (+75, 30) in the orthogonal coordinates. Although the acoustic piano tones are converted to the analog audio signals at (−75, 30), (0, 295) and (+75, 30), the corresponding electronic tones are radiated from (−75, 30), (0, 50) and (+75, 30). The left recording point (−75, 30) and right recording point (+75, 30) are respectively consistent with the left tone radiating point (−75, 30) and right tone generating point (+75, 30). However, the center recording point (0, 295) is different from the center tone radiating point (0, 50). The electric tone radiated from the center loud speaker 32 is to be varied in loudness and initiation of generation.

The loudness is inversely proportional to the square of the distance, and the time lug is increased proportionally to the distance. The volume parameter is representative of the ratio of loudness between the acoustic piano tone and the electronic tone to be generated, and the delay parameter is representative of the delay to be introduced in microsecond. In the following description, unit "S" is indicative of a time consumed by the sound traveling 1 centimeter. The sound is assumed to be propagated in the air at 340 meter per second so that unit S is equivalent to 29.41 microseconds.

Although the left tone radiating point and right tone radiating point are consistent with the left recording point and right recording point, the tone radiating points may be spaced from the corresponding recording points in another playing system. For this reason, the volume parameters and delay parameters are hereinafter calculated for the other tone radiating points.

(Xml, Yml), (Xmm, Ymm) and (Xmr, Ymr) represent the coordinates of the recording points ML, MM and MR, respectively, and (Xsl, Ysl), (Xsm, Ysm) and (Xsr, Ysr) represent the coordinates of the tone radiating points SL, SM and SR, respectively. The volume parameters VL, VM, VR at the tone radiating points SL, SM and SR are given as $$VL=(Xsl^2+Ysl^2)/(Xml^2+Yml^2) \quad \text{Equation 1}$$

$$VM=(Xsm^2+Ysm^2)/(Xmm^2+Ymm^2) \quad \text{Equation 2}$$

$$VR=(Xsr^2+Ysr^2)/(Xmr^2+Ymr^2) \quad \text{Equation 3}$$

The delay parameters DL, DM and DR at the tone radiating points SL, SM and SR are given as $$DL=\{(Xml^2Yml^2)^{1/2}-(Xsl^2+Ysl^2)^{1/2}\}\times S \quad \text{Equation 4}$$

$$DM=\{(Xmm^2Ymm^2)^{1/2}-(Xsm^2+Ysm^2)^{1/2}\}\times S \quad \text{Equation 5}$$

$$DR=\{(Xmr^2Ymr^2)^{1/2}-(Xsr^2+Ysr^2)^{1/2}\}\times S \quad \text{Equation 6}$$

The above described coordinates are substituted for the Xml, Yml, Xmm, Ymm, Xmr, Ymr, Xsl, Ysl, Xsm, Ysm, Xsr and Ysr. Then, the volume parameters VL, VM and VR and delay parameters DL, DM and DR are calculated as

VL=1, DL=0

VM=0.0287, DM=7206

VR=1, DR=0

The read-out unit (0) stores these volume parameters VL, VM and VR and delay parameters DL, DM and DR in the internal memory as the pieces of control data, and waits for the second and third data fields n(0)-n(6)/v(0)-v(6) or only the third data field v(0)-v(6). When the read-out unit (0) receives the control signal representative of the delay of the electronic tone, the read-out unit (0) starts to delay the electronic tone.

The read-out unit (0) is assumed to receive the second and third data fields n(0)-n(6)/v(0)-v(6) from the key assigner 44. The read-out unit (0) accesses the sub-holder with the sub-holder address corresponding to the pitch name n(0)-n(6), and successively reads out the three series of pieces of waveform data from the files L, M and R in the sub-holder in response to the clock signal supplied from the oscillator 46 in a parallel data processing such as, for example, a time sharing fashion. However, the first pieces of waveform data are read out from the files L, M and R at the expiry of the time periods equal to the time lugs represented by the delay parameters DL, DM and DR. Thus, the read-out unit (0) starts to read out the first pieces of waveform data at the expiry of the time periods, and continues to read out the other pieces of waveform data at regular intervals of $1/48000$ second.

The read-out unit (0) adjusts each piece of waveform data to an appropriate value. The adjustment is carried out two steps. The first step is called as "velocity control". In the velocity control, the read-out unit (0) multiplies the value of the piece of waveform data by the quotient of division (value of v-bits)/127. In the second step, the read-out unit (0) multiplies the product by the associated volume parameter VL, VM or VR. Thus, the pieces of waveform data are modified with the pieces of control data, and the modified pieces of waveform data are supplied to the mixing units 47.

The mixing units 47 includes three mixers L, M and R, and are respectively associated with the left, center and right loud speakers 31, 32 and 33.

The plural series of pieces of waveform data representative of the electronic tones to be radiated through the left speakers 31 are supplied from the readout units (0)-(31) to the mixer L, and the mixer L mixes the pieces of waveform data with one another. Similarly, the plural series of pieces of waveform data representative of the electronic tones to be radiated through the left speakers 32 are supplied from the read-out units (0)-(31) to the mixer M, and the mixer M mixes the pieces of waveform data with one another. The plural series of pieces of waveform data representative of the electronic tones to be radiated through the left speakers 33 are supplied from the read-out units (0)-(31) to the mixer R, and the mixer R mixes the pieces of waveform data with one another.

The read-out unit (0) is assumed to receive only the third data field v(0)-v(6) from the key assigner 44. The read-out unit (0) repeats the data read-out from the same sub-holder, and modifies the pieces of waveform data as similar to those described hereinbefore in conjunction with the reception of the second and third data fields n(0)-n(6)/v(0)-v(6). The read-out unit (0) introduces the time lugs into the access to the sub-holder, and adjust the pieces of waveform data to the appropriate value through the two-step modification.

The key assigner 44 is assumed to supply the control signal representative of the decay of electronic tone to the read-out unit (0). The read-out unit (0) waits for the time periods indicated by the delay parameters DL, DM and DR, and stops the data transfer to the mixers L, M and R at the expiry of the time periods.

Each of the mixers L, M and R are associated with the thirty-two read-out units (0)-(31), and receives the series of pieces of waveform data read out from the files L, M or R of the sub-holders. In other words, each of the mixers L, M or R receives concurrently thirty-two pieces of waveform data at the maximum. Of course, each of the pieces of waveform data has been treated with the third data field v(0)-v(6), delay parameter DL/DM/DR and volume parameter VL/VM/VR.

The mixers L, M and R calculate the sum of the pieces of waveform data concurrently arriving thereat, and supply pieces of waveform data respectively representative of the sums to associated digital-to-analog converting circuits L, M and R of the digital-to-analog converter 48. The mixers L, M and R are responsive to the clock signal so that the calculation and data transfer to the digital-to-analog converting circuits are completed within the time period of $1/48000$ second.

The digital-to-analog converter 48 includes the digital-to-analog converters L, M and R, low-pass filters and amplifiers 10*e*. The low-pass filters and amplifiers 10*e* are similar to those of the digital-to-analog converter 16 shown in FIG. 2, and no further description is hereinafter incorporated for the sake of simplicity. The digital-to-analog converters L, M and R receive the pieces of waveform data from the mixers L, M and R, respectively, at the intervals of $1/48000$ second, and convert the pieces of waveform data to parts of three analog audio signals. The analog audio signals are supplied to the loud speakers 31, 32 and 33, respectively, and are converted to the electronic tone through the loud speakers 31, 32 and 33.

The loud speakers 31, 32 and 33 are of the type having a diaphragm and a voice coil. Since the read-out units (0)-(31) have modified the pieces of waveform data with the pieces of control data, i.e., the delay parameters DL, DM and DR and volume parameters VL, VM and VR, the electronic tone radiated from the loud speaker 32 is delayed from the electronic tone radiated from the loud speakers 31/33, and is different in loudness from the electronic tone radiated from the loud speakers 31/33. Thus, the electronic tone exhibits the acoustic radiation characteristics close to those of the acoustic tones. For this reason, the electronic tones leave the impression analogous to the acoustic tones on the user and other listeners.

Performance on Electronic Musical Instrument

Assuming now that a user wishes to perform a piece of music on the keyboard 10*a*, the user selects the timbre of convert grand piano "G" from the candidates through the manipulating panel 50. The controller 49 acknowledges the user's instruction, and requests the data memory 41 to transfer the group of waveform data sets and the pieces of positional data representative of the recording points ML/MM/MR and tone radiating points SL/SM/SR to the waveform memory 42 and the thirty-two read-out units (0)-(31), respectively.

The group of waveform data sets is stored in the waveform memory 42, and each set of waveform data series becomes addressable with the sub-holder address. The read-out units (0)-(31) calculate the delay parameters DL/DM/DR and volume parameters VL/VM/VR on the basis of the pieces of positional data representative of the recording points ML/MM/MR and tone radiating points SL/SM/SR, and store the delay parameters DL/DM/DR and volume parameters VL/VM/VR in the respective internal memories.

Upon completion of the preparatory work, the controller 49 requests the display 51 to notify the user of the completion of preparatory work by using an appropriate message.

When the user acknowledges the completion of preparatory work, the user starts his or her performance. The user selectively depresses the keys and releases the depressed keys on the keyboard 10*a*. While the user is fingering on the keyboard 10*a*, the key assignor 44 intermittently selectively distribute the second and third data fields n(0)-n(6)/v(0)-v(6), third data fields v(0)-v(6) and/or control signal representative of the decay to the read-out units (0)-(31).

When the read-out units (0)-(31) receive the second/third data fields n(0)-n(6)/v(0)-v(6) or third data field v(0)-v(6), the read-out units (0)-(31) read out the sets of waveform data series from the sub-holders, and modify the pieces of waveform data with the delay parameters DL/DM/DR, data code in the third data field v(0)-v(6) and volume parameters VL/VM/VR as described hereinbefore in detail Upon completion of the data modification, the read-out units (0)-(31) supply the pieces of waveform data to the mixers L/M/R, and the pieces of waveform data are mixed into three series of waveform data. The three series of pieces of waveform data are supplied to the digital-to-analog converting circuits L, M and R for the digital-to-analog conversion to the analog audio signals, and the analog audio signals are converted to the electric tones through the loud speakers 31/32/33. When the key data codes representative of the note-off reach the key assignor 44, the key assignor 44 supplies the control signal representative of the decay to the readout units, and the read-out units stops the data read-out at the expiry of the time periods indicated by the delay parameters DL/DM/DR. Then, the electronic tones are delayed.

As will be understood from the foregoing description, the tone generating system, i.e., the multi-channel sampled data storage type electronic keyboard modifies the pieces of waveform data with the pieces of control data so that the electronic tone at the loud speakers 31/32/33 is delayed and/reduced in loudness depending upon the differences between the recording points ML/MM/MR and the tone radiating points SL/SM/SR. It is not necessary to make the tone generating points SL/SM/SR consistent with the recording points ML/MM/MR. This means that the manufacturer can arrange the loud speakers in an area narrower than the area required for the microphones 2/3/4. Thus, the manufacturer offers a small-sized tone generating system to users without change of the acoustic radiation characteristics.

Second Embodiment

System Configuration

Figure 9A:
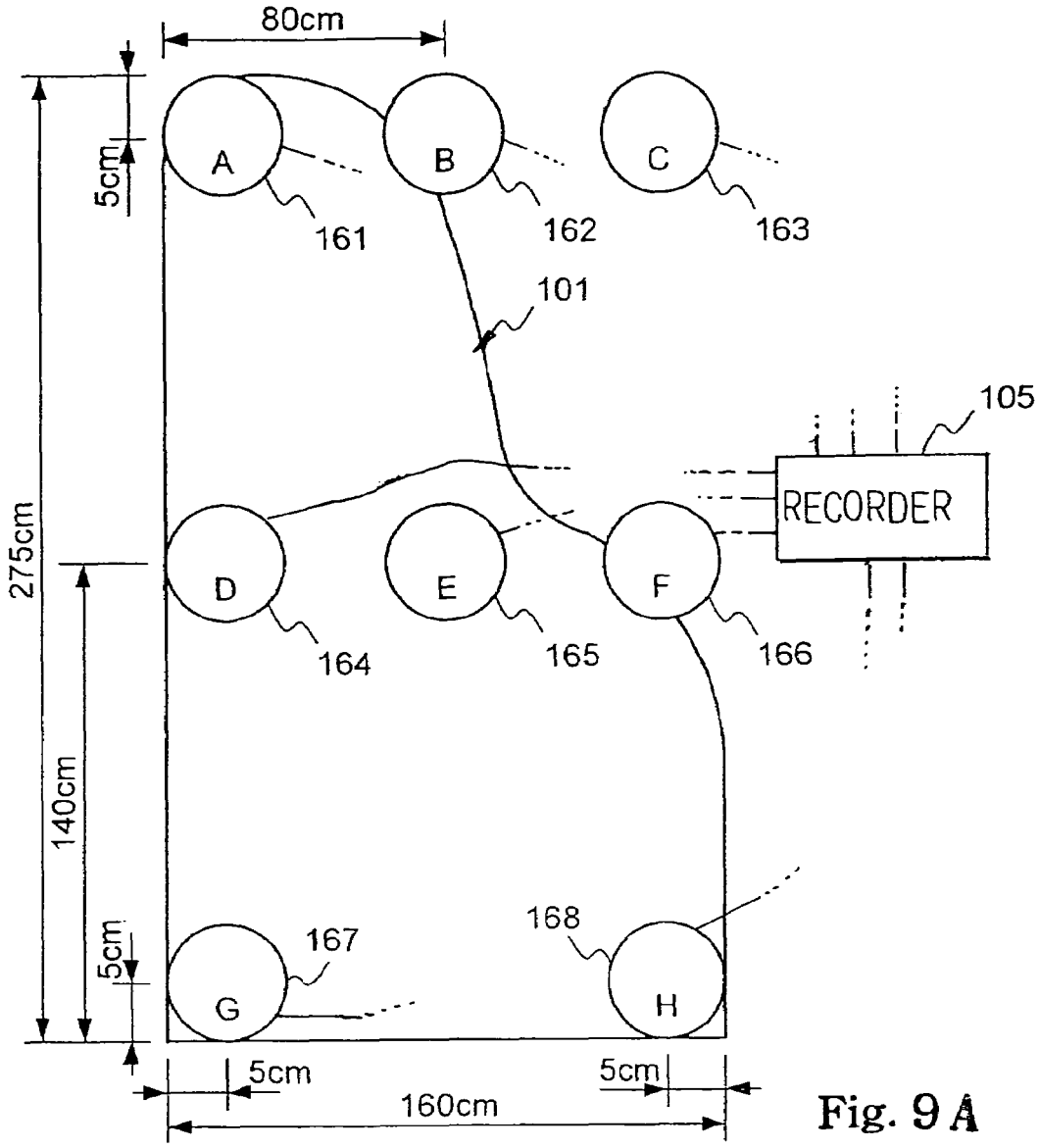
FIG. 9A is a schematic plane view showing another recording system according to the present invention.
Figure 9B:
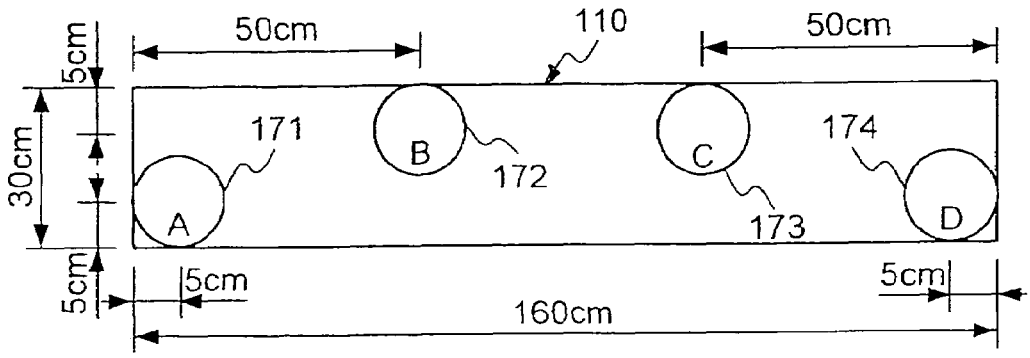
FIG. 9B is a schematic plane view showing another electronic musical instrument according to the present invention.

FIGS. 9A and 9B show another recording system and another sound generating system embodying the present invention. The recording system 101 comprises a concert grand piano 101, a recorder 105 and eight microphones 161, 162, 163, 164, 165, 166, 167 and 168. The eight microphones 161 to 168 are respectively disposed at recording points A, B, C, D, E, F, G and H over the sound board, and are connected to the recorder 105 through audio cables. The concert grand piano 101 is same as the concert grand piano 1*a*, and the recorder 105 will be hereinlater described in detail. When the component parts of the concert grand piano 101 are referred to, the component parts are accompanied with the references designating the corresponding component parts shown in FIG. 1A.

The sound generating system 110 is implemented by an electronic musical instrument 110, which is also similar to the multi-channel sampled data storage type electronic keyboard instrument 10 except the number of loud speakers 171, 172, 173 and 174. The data processing system incorporated in the electronic musical instrument 110 will be hereinlater described in detail. The loud speakers 171 to 174 are respectively disposed at tone radiating points A, B, C and D, and are connected to the data processing system. Thus, the number of tone radiating points A to D is less than the number of recording points A to H. This is the difference between the first embodiment and the second embodiment.

The measurements inserted into FIGS. 9A and 9B are indicative of the distance from the periphery of the piano 101 or cabinet to the recording points A to H or tone radiating points A to D. In detail, the recording points A, B and C are spaced from the front end line of the concert grand piano 101 by 270 centimeters, and the recording points A/B and recording point C are spaced from the left sideline by 5 centimeters and 80 centimeters and from the right sideline by 5 centimeters, respectively. The recording points D, E and F are spaced from the front end line of the concert grand piano 101 by 140 centimeters, and the recording points D/E and recording point F are spaced from the left sideline by 5 centimeters and 80 centimeters and from the right sideline by 5 centimeters, respectively. The recording points G and H are spaced from the front end line of the concert grand piano 101 by 5 centimeters, and the recording points G and H are spaced from the left sideline by 5 centimeters and from the right sideline by 5 centimeters, respectively.

When the recording points A-H are plotted in the orthogonal coordinate system shown in FIG. 4, coordinates MA to MH are given as follows:

MA (Xma, Yma)=MA (−75, 295)
MB (Xmb, Ymb)=MA (0, 295)
MC (Xmc, Ymc)=MC (+75, 295)
MD (Xmd, Ymd)=MD (−75, 165)
ME (Xme, Yme)=ME (0, 165)
MF (Xmf, Ymf)=MF (+75, 165)
MG (Xmg, Ymg)=MG (−75, 30)
MH (Xmh, Ymh)=MH (+75, 30)

On the other hand, the tone radiating points A and H are spaced from the front end line of the cabinet by 5 centimeters, and are spaced from the left sideline by 5 centimeters and from the right sideline by 5 centimeters. The tone generating points B and C are spaced from the front end line of the cabinet by 25 centimeters, and are spaced from the left sideline by 50 centimeters and from the right sideline by 50 centimeters. When the tone radiating points A to D are plotted in the orthogonal coordinate system shown in FIG. 6, coordinates SA, SB, SC and SD are given as follows:

SA (Xsa, Ysa)=SA (−75, 30)
SB (Xsb Ysb)=SB (−30, 50)
SC (Xsc, Ysc)=SA (+30, 50)
SD (Xsd, Ysd)=SD (+75, 30)

System Configuration of Recorder

Figure 10:
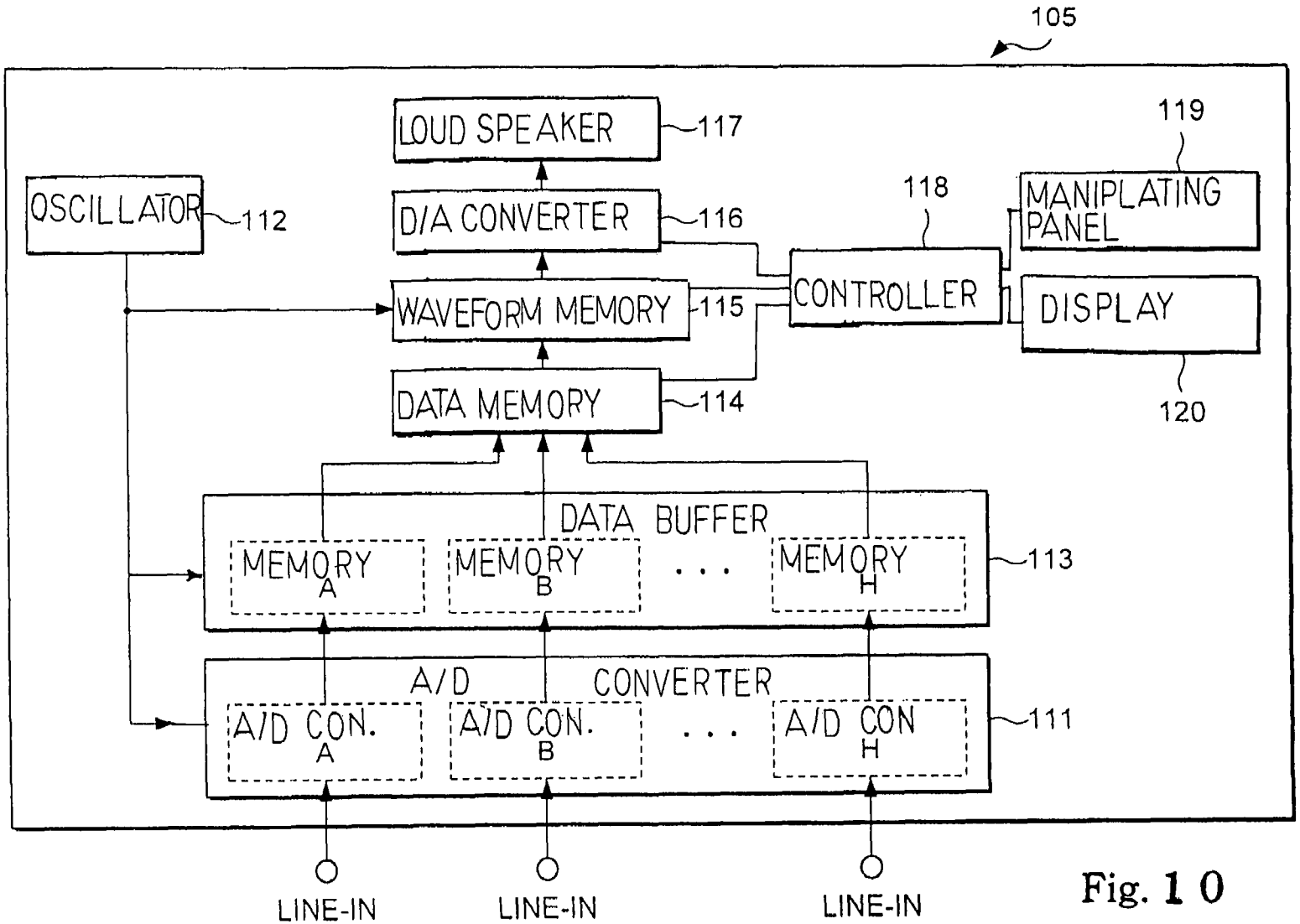
FIG. 10 is a block diagram showing the system configuration of a recorder incorporated in the recording system.

FIG. 10 shows the system configuration of the recorder 105. The recorder 105 includes an analog-to-digital converter 111, an oscillator 112, a data buffer 113, a data memory 114, a waveform memory 115, a digital-to-analog converter 116, a loud speaker 117, a controller 118, a manipulating panel 119 and a display 120. The recorder 105 is similar to the recorder 5 except the analog-to-digital converter 111 and buffer memory 113. For this reason, description is focused on the analog-to-digital converter 111 and buffer memory 113.

The analog-to-digital converter 111 includes eight analog-to-digital converting units A, B, . . . and H, and the analog audio signals are supplied from the microphones 161 to 168 to the analog-to-digital converting units A to H, respectively. The analog-to-digital converting units A to H are similar in system configuration to the analog-to-digital converting units L, M and R shown in FIG. 2, and are responsive to the clock signal supplied from the oscillator 112 for sampling discrete values on the analog audio signals and converting the discrete values to eight series of pieces of waveform data. Thus, the eight analog-to-digital converting units A to H behave as similar to those of the analog-to-digital converter 11.

The buffer memory 113 includes eight memory units A, B, . . . and H, and the eight memory units A, B, . . . and H are respectively connected to the eight analog-to-digital converting units A to H. The eight series of pieces of waveform data or eight series of data codes are respectively supplied from the analog-to-digital converting units A to H, and are temporarily stored in the associated memory units A to H, respectively. The memory units A to H transfer the series of pieces of waveform data to the data memory, and the eight series of pieces of waveform data are respectively stored in a sub-holder in the data memory 114.

Figure 11:
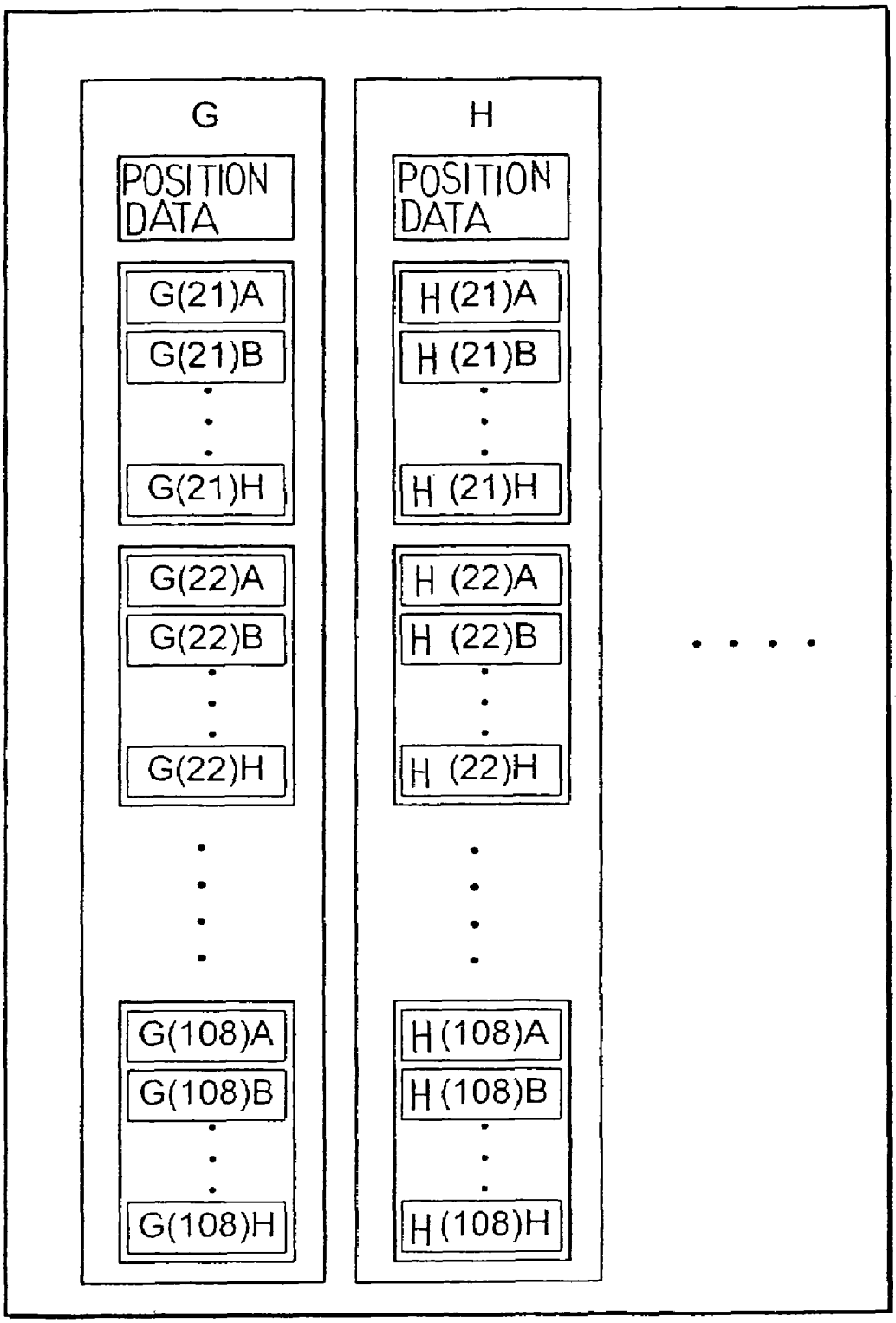
FIG. 11 is a view showing contents of a data memory incorporated in the recorder.

FIG. 11 shows data holders G, H, . . . respectively assigned groups of acoustic tones different in timbre from one another. Each holder G/H includes eighty-eight sub-holders, and the eighty-eight keys are respectively assigned the eighty-eight sub-holders. Each sub-holder has eight files G(21)A/G(21)B/ . . . /G(21)H, G(22)A/G(22)B/ . . . /G(22)H, . . . G(108)A/G(108)B/ . . . /G(108)H, H(21)A/H(21)B/ . . . /H(21)H, H(22)A/H(22)B/ . . . /H(22)H, . . . H(108)A/H(108)B/ . . . /H(108)H. The eight microphones 161 to 168 are respectively assigned the eight groups of files A to H, and the eight series of pieces of waveform data representative of each acoustic tone are respectively stored in the eight files of each sub-holders. The coordinates MA to MH are stored in each holder as pieces of positional data representative of the recording points A to H.

The timbre of the acoustic piano tones is expressed as "G", and the leftmost data holder "G" is assigned to the group of waveform data sets recorded by means of the recorder 105. The method for recording the acoustic piano tones is similar to that of the first embodiment, and description is omitted for the sake of simplicity.

System Configuration of Electronic Musical Instrument

Figure 12:
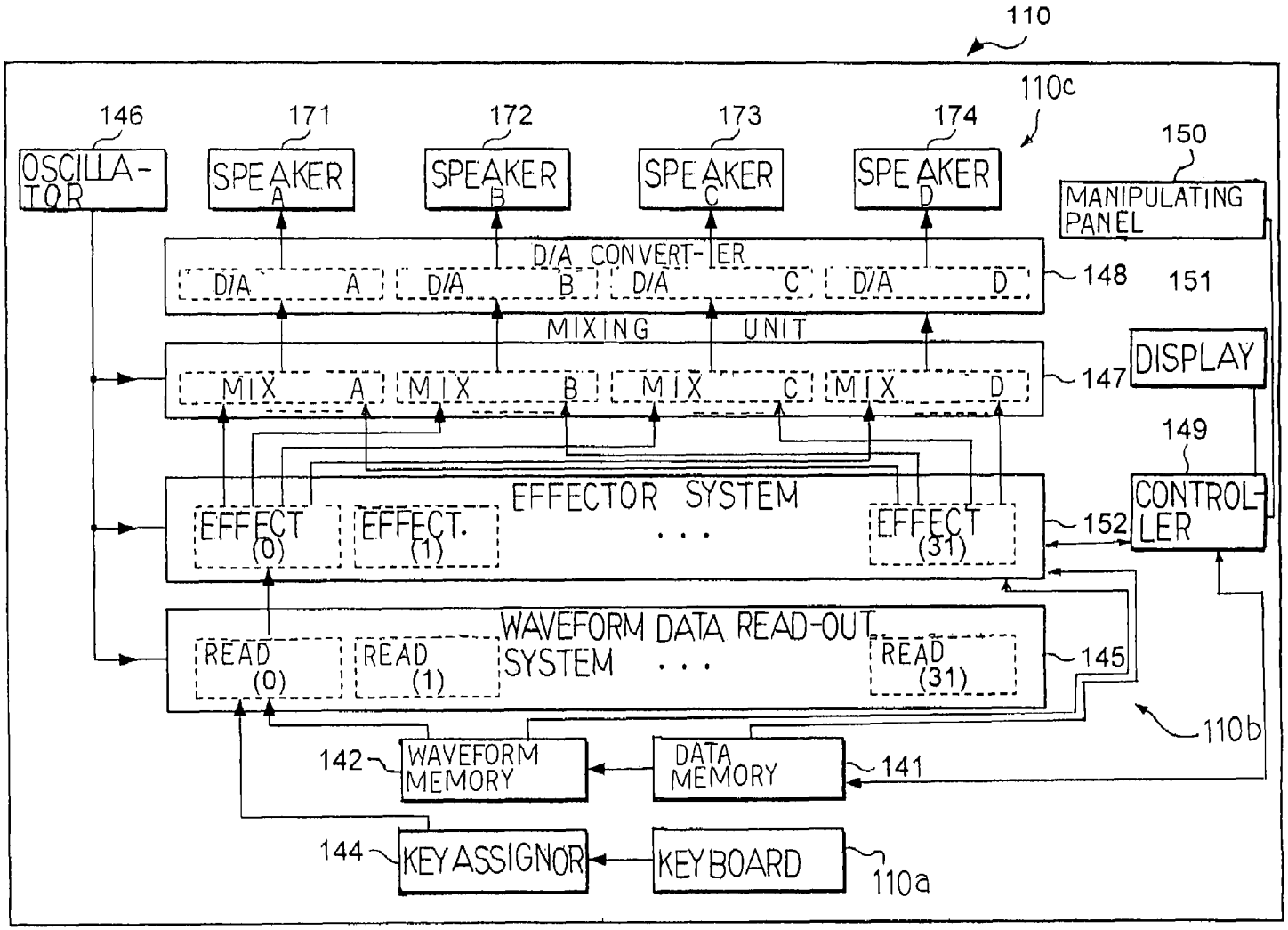
FIG. 12 is a block diagram showing the system configuration of the electronic musical instrument.

FIG. 12 shows the system configuration of the electronic musical instrument 110. The electronic keyboard musical instrument 110 includes a keyboard 10*a*, a data processing system 110*b* and a sound system 110*c*. The keyboard 110*a* includes eighty-eight keys, and the sound system 110*c* includes amplifier (not shown) and the four loud speakers 171, 172, 173 and 174. The keyboard 110*a* and sound system 110*c* are similar to those of the first embodiment, and no further description is hereinafter incorporated for avoiding repetition.

The data processing system 110*b* includes a data memory 141, a waveform memory 142, a key assigner 144, a waveform data read-out system 145, an oscillator 146, a mixing unit 147, a digital-to-analog converter 148, a controller 149, a manipulating panel 150, a display 151 and an effector system 152. The system components of the data processing system 110*b* are similar to those of the system components of the data processing system 10*b* except the oscillator 146, data memory 141, waveform data read-out system 145, mixer 147, digital-to-analog converter 148 and effector system 152. For this reason, description is focused on these system components.

The oscillator 146 generates a clock signal, which is adjusted to 48 kHz as similar to the oscillator 46. A difference is the destinations of the clock signal.

The oscillator 146 is connected to the waveform data read-out system 145, mixing unit 147 and effector system 152, and supplies the clock signal to those system components 145, 147 and 152.

The data memory 141 has a magnetic disc, and the data holders G, H, . . . are stored in the magnetic disc. When the controller 149 supplies a control signal representative of the piece of tone color data to the data memory 141, the data memory supplies the pieces of positional data representative of the recording points MA to MH and tone radiating points SA to SD to the effector system 152. The user has inputted the coordinates at the tone radiating points SA to SD, and the coordinates are stored in the magnetic disc.

The waveform data read-out system 145 includes thirty-two read-out units (0) to (31). The thirty-two read-out units (0) to (31) are responsive to the second data field n(0)-n(6) supplied from the key assignor 144, and selectively accesses the sub-holders for reading out the sets of waveform data series in parallel to one another as similar to the waveform data read-out system 45. The read-out units (0) to (31) transfer the pieces of waveform data to the effector system 152 without modification with delay and volume parameters.

When the read-out units (0)-(31) receives the control signal representative of the decay of electronic tones, the read-out units (0)-(31) stop the data transfer to the effector system 152, and do not prolong the read-out time indicated by the delay parameters.

The effector system 152 includes thirty-two effectors (0) to (31), and the thirty-two read-out units (0) to (31) respectively supplies the sets of waveform data series to the associated effectors (0) to (31). The effectors (0) to (31) calculate the delay parameters and volume parameters upon reception of the pieces of positional data, and modify the pieces of waveform data with pieces of control data such as the delay parameters and volume parameters during a performance. The effectors (0) to (31) supply the pieces of waveform data to the mixing unit 147 after the modification. The effectors (1) to (31) are same in system configuration and function as the effector (0) so that description is only made on the effector (0).

The effector (0) includes a large-capacity buffer memory, and thirty-two delay paths are created in the large-capacity buffer memory. Each of the delay paths can store the pieces of waveform data equivalent to 1 second, and has plural taps for outputting the pieces of waveform data. In other words, if the output port is changed from a tap to another tap, the delay time is varied The thirty-two delay paths are respectively assigned the thirty-two combinations of the eight microphones 161-168 and four loud speakers 171-174. The thirty-two delay paths or queues are correlated with the thirty-two combinations as follows. The first microphone A form four queues together with the four loud speakers A to D as AA, AB, AC and AD, and the second microphone B also form four cures together with the four loud speakers A to D as BA, BB, BC and BD. The microphones A-H occupy the first position, and the loud speakers A-D occupy the second position. Then, the thirty-two queues are expressed as follows.

Queue AA, queue AB, queue AC and queue AD

Queue BA, queue BB, queue BC and queue BD

: : : :

: : : :

Queue HA, queue HB, queue HC and queue HD

As described hereinbefore, the number of microphones 161-168 is different from the number of loud speakers 171-174. This means that equations 1 to 6 are not available for the second embodiment. The delay parameters and volume parameters are determined on the basis of the following recognition.

A hammer 1*e* is assumed to strike the associated string 1*f*. The string 1*f* vibrates, and gives rise to vibrations of the sound board 1*g*. The acoustic piano tone is radiated from the entire surface of the sound board 1*g*. The vibrations at the recording point A are three-dimensionally spread as a series of sound waves, and the series of sound waves passes through the tone radiating points A to D. Similarly, the vibrations at the other recording points B to H are also three-dimensionally spread as plural series of sound waves, and each series of sound waves passes through the tone generating points A to D. Thus, the acoustic piano tone is equivalent to the plural series of sound waves radiated at the recording points A to H, and the plural series of sound waves reach the user and other listeners through the tone radiating points A to D. While each series of sound waves is being propagated, the time lug is introduced in the propagation, and the loudness is gradually reduced. For this reason, the effectors (0) to (31) calculate the delay parameters and volume parameters on the basis of the distances between the eight recording points A to H and the four tone radiating points A to D.

Followings are an example of the method for determining the delay parameters and volume parameters. However, the following method does not set any limit on the scope of the present invention, because various approaches are available for determination of those parameters.

The coordinates MI of the recording points A to H are expressed as MI (Xmi, Ymi) where I={I|A, B, . . . H}, and the coordinates SJ of the tone radiating points A to D are expressed as SJ (Xsj, Ysj) where J={J|A, B, C, D}. The origin H of the orthogonal coordinate system is plotted at (0, 0). S is representative of the time period consumed by the sound wave traveling 1 centimeter, and is 29.41 microsecond.

The distance Dij between the recording point XI and the tone radiating point SJ is given as $$Dij=\{(Xmi-Xsj)^2+(Ymi-Ysj)^2\}^{1/2} \quad \text{Equation 7}$$

The distance Djh between the tone radiating points A-D and the origin H is given as $$Djh=(Xsj^2+Ysj^2)^{1/2} \quad \text{Equation 8}$$

The volume parameters IJ1 and delay parameters IJ2 are given by equations 9 and 10.

$$IJ1=Dij^2/(Dij+Dih)^2 \quad \text{Equation 9}$$

$$IJ2=Dij\times S \quad \text{Equation 10}$$

Using equations 9 and 10, the volume parameters IJ1 and delay parameters IJ2 are calculated as shown in FIG. 13.

Upon completion of the calculations, the effector (0) adjusts an address pointer to an output address representative of one of the taps. If the delay parameter for the combination AB is approximately equal to 7326 microseconds. The delay time is 352 times longer than the pulse period of the clock signal, i.e., $352\times 1/48000$. Then, the effector (0) adjusts the address pointer to the output address indicative of the tap at the $352^{nd}$ stage. The pieces of waveform data are shifted from stage to stage in response to the clock signal so that the queue introduces the delay time into the propagation of the pieces of waveform data. The effector (0) adjusts the other address pointers to output addresses equivalent to the delay parameters for the queues AA and AC to HD.

The other effectors (1) to (31) similarly adjust the taps of the queues to the delay parameters. Upon completion of the preparatory work, the effectors (0) to (31) start to supply pieces of waveform data to the mixers A to D. Although the effectors (0) to (31) continuously supply the pieces of waveform data, the pieces of waveform data are representative of silence until the effectors (0) to (31) receive the pieces of waveform data from the read-out units (0) to (31).

Another task to be achieved by the effectors (0) to (31) are the velocity control. When the key assignor 142 assigns the second data field n(0)-n(6) to one of the read-out units (0)-(31), the key assigner 142 further supplies the third data field v(0)-v(31) to the associated effector, and the effector multiplies the value of each piece of waveform data by the value represented by the bits v(0)-v(31) for the volume control.

Yet another task to be achieved by the effectors (0) to (31) is to multiply the values of the pieces of waveform data by the volume parameters. Each series of pieces of waveform data is assigned to four cures, and are output from the selected taps, and the eight pieces of waveform data are propagated through the thirty-two queues. Each of the effectors (0) to (31) multiplies the values of the thirty-two pieces of waveform data by the values of the associated thirty-two volume parameters, respectively, after the volume control, and selectively supplies the thirty-two pieces of waveform data to the four mixers A, B, C and D. The pieces of waveform data output from the queues "XA", where X is A to H, are supplied to the mixer A, and the pieces of waveform data output from the queues "XB", where X is A to H, are supplied to the mixer B. Similarly, the pieces of waveform data output from the queues "XC", where X is A to H, are supplied to the mixer C, and the pieces of waveform data output from the queues "XD", where X is A to H, are supplied to the mixer D. The pieces of waveform data enter queues, and are successively supplied to the mixers A, B, C and D.

The mixing unit 147 includes the four mixers A, B, C and D, and the four mixers A to D are respectively associated with the four loud speakers 171, 172, 173 and 174. Each of the read-out units supplies the eight pieces of waveform data to every mixing unit so that every mixer mixes two hundred fifty-five pieces of waveform data into a piece of waveform data at the maximum. The mixing units A to D supply the four series of pieces of waveform data to the digital-to-analog converting units A, B, C and D, respectively.

The digital-to-analog converting units A to D convert the four series of pieces of waveform data to four analog audio signals, and supply the four analog audio signals to the sound system 110*c*.

The sound system 110*c* includes the amplifiers (not shown) and loud speakers 171-174, and the loud speakers 171 to 174 are disposed at the four tone radiating points A to D, respectively. The analog audio signals are amplified, and the loud speakers 171 to 174 produce the electronic tones from the analog audio signals.

Performance on Electronic Keyboard

When a user makes his or her option in the timbre through the manipulating panel 150, the controller 149 determines the data holder, and requests the data memory 141 to transfer the group of waveform data sets and the pieces of positional data representative of the recording points MA-MH and tone radiating points SA-SD from the data holder corresponding the selected timbre to the waveform memory 142 and the effector system 152, respectively. The user is assumed to select the piano tones. The group of waveform data sets G is stored in the waveform memory 142, and the delay parameters and volume parameters are stored in each of the effectors (0) to (31). When the preparatory work is completed, the completion of preparatory work is reported to the controller 149, and the controller 149 notifies the user that the data processing system 10*b* gets ready to respond to fingering on the keyboard 110*a*.

The user starts to perform a piece of music. While a user is fingering on the keyboard 110*a*, the key assignor 144 records new assign data codes in the assign list, and distributes the key codes c(0) to c(6) and volume codes v(0) to v(6) to the read-out units already assigned to the key codes c(0) to c(6) and the associated effectors.

The read-out units access the waveform memory 142 in parallel to one another, and reads out sets of waveform data series from the sub-holders. The read-out units supply the sets of waveform data series to the associated effectors.

The effectors introduce time lugs indicated by the delay parameters into the propagation through the queues, and adjust the pieces of waveform data to appropriate values through the two-step volume control. The pieces of waveform data are converted to the analog audio signals, and the electronic tones are radiated from the loud speakers 171 to 174.

As will be understood from the foregoing description, the series of sound waves radiated from each loud speaker is equivalent to the eight series of sound waves radiated from each recording point at the tone radiating point. For this reason, the user feels the electronic tones quite close to the acoustic tones. The electronic tones radiated from the four loud speakers give the impression like tones radiated from more than four loud speakers on the ears by virtue of the timing control using the delay parameters and volume control using the volume parameters.

Although the electronic tones are close to the acoustic tones, the number of loud speakers are less than the number of microphones, and the loud speakers occupy an area narrower than the area occupied by the microphones. This results in a small-sized electronic musical instrument. Thus, the timing control and volume control are conducive to the electronic tones close to the acoustic tones without a wide occupation space.

Modifications

Although particular embodiments of the present invention have been shown and described, it will be apparent to those skilled in the art that various changes and modifications may be made without departing from the spirit and scope of the present invention.

The three microphones and three loud speakers do not set any limit on the technical scope of the present invention. Only one microphone, two microphones or more than three microphones may be used in the conversion to the analog audio signals, and, accordingly, only one loud speaker, two loud speakers or more than three loud speakers may be used in the performance.

The eight microphones and four loud speakers do not set any limit on the scope of the present invention. The microphones and loud speakers may be increased or decreased in number.

The measurements inserted in the figures do not set any limit on the technical scope of the present invention. A large-sized grand piano or a small-sized grand piano may form a part of the recording system. Similarly, a large-sized multi-channel sampled data storage type electronic musical instrument or a small-sized multi-channel sampled data storage type electronic musical instrument is fabricated for producing the electronic tones.

The concert grand piano does not set any limit on the technical scope of the present invention. An electronic string or an electronic wind instrument may form a part of the recording system.

The microphones do not set any limit on the technical scope of the present invention. Any sort of converter is available for the recording system 1 in so far as the converter outputs an electric signal representative of the mechanical motion. An example of the converter is piezoelectric converters.

The data holder may be transferred from the recording system to the electronic musical instrument through a cable or a public/private communication system such as, for example, the internet. Otherwise, another sort of portable memory is available for the data holder or holders. Examples of the portable memory are RAM card, a memory board with semiconductor memory devices, CD-ROM and optical discs.

The data codes may be transferred from the data buffer 13 to the data memory 14 in an overlapped manner with the data transfer from the analog-to-digital converter 11 to the data buffer 13. In this instance, the volatile memories may have an input address/data port and an output address/data port concurrently available for the data write-in and data read-out. Otherwise, the volatile memories of the data buffer 13 may be implemented by FIFO (First-In First-Out) circuits.

In the recording sequence, if the user does not want to confirm the electronic tone, the user repeats the keying-in without the request for the confirmation, and the recorder 5 creates other sub-holders 142 to 14*n* so as to store the sets of waveform data series therein.

In yet another recording system, the user may record selected ones of the acoustic tones. The sets of waveform data series are stored in the sub-holders, and other sets of waveform data series are produced on the basis of the sets of waveform data series through modification of pitches/volume characteristics. Thus, the other sets of waveform data series are interpolated, and form a group of waveform data sets together with the sets of waveform data series already recorded. Thus, the method according to the present invention is never restricted to the sequential keying-in for all the acoustic tones.

Another effector system may be inserted between the waveform data readout system 145 and the effector system 152 for imparting another effect to the electronic tones.

Equations 1 to 6 and equations 7 to 10 do not set any limit on the technical scope of the present invention. In case where the recording points and tone radiating points are plotted in a polar coordinate system, the delay parameters and volume parameters are expressed by another set of equations.

In the above-described embodiments, the delay parameters and volume parameters are used for the timing control and two-step volume control without any change. However, the delay parameters and volume parameters may be biased or modified by the user.

The microphones and loud speakers may be three-dimensionally arranged in a space under and over the sound board. In this instance, the recording points and tone generating points are plotted in a three-dimensional coordinate system, and are expressed as (x, y, z). Of course, the above-described equations are to be modified.

The pieces of control data such as the delay/volume parameters are stored in the data memory or another suitable data storage. In this instance, the electronic musical instrument merely reads out the pieces of control data from the data storage. The sound generating system may determine the pieces of control data. Otherwise, another external device is used for the calculation.

Another sound generating system according to the present invention may have only the data processing system and sound system. In this instance, the sound generating system is connected to an external instrument such as, for example, a music sequencer or a personal computer system, and the user specifies the tones to be generated through the external device to the sound generating system.

In the above-described embodiments, the electronic tones are modified in tone radiating timing and volume with the pieces of control data, i.e., delay parameters and volume parameters. However, the delay parameters and volume parameters do not set any limit on the technical scope of the present invention. Any sound effects are available for the tone control. The electronic tones may be modified in reverberation, chorus and/or equalizer with pieces of control data. In case where the reverberation is controlled, the pieces of control data include reverberation parameters.

Moreover, the electronic tones may be generated at timing earlier than the timing for generating the corresponding acoustic tones, and increased in volume. The timing is delayed or accelerated depending upon the relation between the recording points and tone radiating points, and volume are decreased or increased also depending upon the relation between the recording points and tone generating points. Thus, the delay parameters and volume parameters for reducing the volume do not set any limit on the technical scope of the present invention.

A waveform memory may have plural groups of waveform data assigned to electronic tones different in velocity such as, for example, pianissimo, mezzo piano, mezzo forte etc. In this instance, the key assignor supplies both of the n-bits and v-bits (see FIG. 7) to the read-out circuits. The read-out circuit selects one of the plural groups of waveform data from the waveform memory on the basis of the v-bits, and accesses to a series of waveform data codes stored at the address specified with the n-bits.

RELATION BETWEEN CLAIMS AND EMBODIMENTS

First, the terms used in claims are correlated with the terms used in the description on the first and second embodiments. However, the elements of claims are never restricted to the components of the recording/sound generating systems 1/10 and 101/110, because there are various modifications described hereinbefore in detail.

Term "influences" is corresponding to the difference in timing between the acoustic tones and the electronic tones and variation in volume, and sets of modified waveform data series are corresponding to the sets of waveform data series output from the read-out units (0)-(31) or effectors (0)-(31).

An acoustic musical instrument is corresponding to the concert grand piano 1*a*/101. However, the term "acoustic musical instrument" is applicable to other sorts of musical instruments such as, for example, wind instruments and string instruments. A sound-to-electric signal converter is corresponding to the microphones 31-33 or 161-168.

At least one series of mixed waveform data is corresponding to the series of waveform data output from the mixing unit 47/147.

What is claimed is:

1. A method for making electronic tones close to acoustic tones, comprising the steps of:

a) preparing a group of waveform data sets representative of said acoustic tones at least one recording point;

b) determining pieces of control data representative of influences on said electronic tones due to a difference between said at least one recording point and at least one tone radiating point where said electronic tones are to be radiated;

c) designating electronic tones to be generated;

d) selecting sets of waveform data series representative of said electronic tones to be generated from said group of waveform data sets;

e) modifying said sets of waveform data series with said pieces of control data for producing sets of modified waveform data series; and f) converting said sets of modified waveform data series to said electronic tones at said at least one tone radiating point.

2. The method as set forth in claim 1, in which said at least one recording point contains plural recording points so that each of said sets of waveform data series has plural series of waveform data representative of one of said acoustic tones at said plural recording points, respectively, and said at least one tone generating point contains plural tone generating points so that said one of said acoustic tones is generated at said plural tone generating points on the basis of said plural series of waveform data of said each of said sets of waveform data series and said pieces of control data.

3. The method as set forth in claim 2, in which said plural recording points are equal in number to said plural tone generating points.

4. The method as set forth in claim 3, in which the series of sound waves of each acoustic tone at said plural recording points have said influences on the series of sound waves of a corresponding electronic tone radiated at said plural tone radiating points, respectively.

5. The method as set forth in claim 4, in which said influences are due to said difference in position between said plural recording points and the corresponding tone radiating points.

6. The method as set forth in claim 5, in which said influences are a time lug between the generation of each acoustic tone and the corresponding electronic tone and a difference in volume between said each acoustic tone and said corresponding electronic tone.

7. The method as set forth in claim 2, in which said plural recording points are different in number from said plural tone generating points.

8. The method as set forth in claim 7, in which the series of sound waves of each acoustic tone at one of said plural recording points have said influences on the series of sound waves of a corresponding electronic tone radiated at all of said plural tone radiating points.

9. The method as set forth in claim 8, in which said influences are due to said difference in position between said plural recording points and the corresponding tone radiating points.

10. The method as set forth in claim 9, in which said influences are a time lug between the generation of each acoustic tone and the corresponding electronic tone and a difference in volume between said each acoustic tone and said corresponding electronic tone.

11. The method as set forth in claim 1, in which said step a) includes the sub-steps of a-1) converting each of said acoustic tones to at least one analog audio signal at said at least one recording point, a-2) sampling momentary discrete values from said at least one audio signal at time intervals, a-3) converting said momentary discrete values to binary numbers, respectively, a-4) storing said binary numbers as one of said sets of waveform data series, and a-5) repeating said sub-steps a-1) to a-4) for others of said acoustic tones.

12. The method as set forth in claim 1, in which said step b) includes the sub-steps of b-1) determining pieces of positional data representative of said at least one recording point and said at least one tone radiating point, b-2) determining a geometrical difference between said at least one recording point and said at least one tone radiating point on the basis of said pieces of positional data, b-3) determining said influences of said acoustic tones on said electronic tones on the basis of said geometrical difference, and b-4) producing said pieces of control data representative of said influences.

13. The method as set forth in claim 12, in which said influences are a time lug between the generation of each acoustic tone and the corresponding electronic tone and a difference in volume between said each acoustic tone and said corresponding electronic tone.

14. The method as set forth in claim 13, in which said pieces of control data representative of said time lug is varied in proportional to a length between said at least one recording point and said at least one tone generating point.

15. The method as set forth in claim 14, in which said time lug is introduced by changing timings at which the first piece of waveform data is read out from each of said sets of waveform data series.

16. The method as set forth in claim 14, in which said time lug is introduced by changing timings at which the first piece of modified waveform data is convened to a part of each electronic tone.

17. The method as set forth in claim 13, in which said pieces of control data representative of said difference in volume is varied in inversely proportional to the square of a length between said at least one recording point and said at least one tone generating point.

18. The method as set forth in claim 17, in which said sets of waveform data series are modified to said sets of modified waveform data series through an arithmetic operation between said sets of waveform data series and said pieces of control data.

* * * * *